US010151329B2

(12) United States Patent
Moore et al.

(10) Patent No.: US 10,151,329 B2
(45) Date of Patent: Dec. 11, 2018

(54) SYSTEMS AND METHODS FOR FLYING SHEET MATERIALS

(71) Applicants: Hamilton G. Moore, Irondale, AL (US); Blake T. Hudson, Smyrna, GA (US)

(72) Inventors: Hamilton G. Moore, Irondale, AL (US); Blake T. Hudson, Smyrna, GA (US)

( * ) Notice: Subject to any disclaimer, the term of this patent is extended or adjusted under 35 U.S.C. 154(b) by 0 days.

(21) Appl. No.: 15/889,179

(22) Filed: Feb. 5, 2018

(65) Prior Publication Data

US 2018/0223872 A1 Aug. 9, 2018

Related U.S. Application Data

(60) Provisional application No. 62/613,768, filed on Jan. 5, 2018, provisional application No. 62/479,037, filed on Mar. 30, 2017, provisional application No. 62/454,744, filed on Feb. 4, 2017.

(51) Int. Cl.

| | |
|---|---|
| ***F04D 29/66*** | (2006.01) |
| ***F04D 25/06*** | (2006.01) |
| ***G09F 17/00*** | (2006.01) |
| ***F04D 19/02*** | (2006.01) |

(52) U.S. Cl.

CPC ..... *F04D 29/664* (2013.01); *F04D 19/024* (2013.01); *F04D 25/0673* (2013.01); *G09F 17/00* (2013.01); *G09F 17/0091* (2013.01); *G09F 2017/0066* (2013.01)

(58) Field of Classification Search

CPC ..... G09F 17/00

See application file for complete search history.

(56) References Cited

U.S. PATENT DOCUMENTS

| | | | | |
|---|---|---|---|---|
| 634,316 | A * | 10/1899 | Whelan | G09F 17/00 40/218 |
| 1,102,270 | A | 7/1914 | Howard | |
| 1,660,341 | A | 2/1928 | Lapworth | |
| 1,725,250 | A * | 8/1929 | Burgess | E04H 12/32 116/173 |

(Continued)

FOREIGN PATENT DOCUMENTS

| | | |
|---|---|---|
| CN | 2113533 | 8/1992 |
| CN | 203179452 | 9/2013 |

(Continued)

OTHER PUBLICATIONS

International Search Report for PCT Serial No. PCT/US2018/016932 dated May 17, 2018.

*Primary Examiner* — Gary C Hoge

(74) *Attorney, Agent, or Firm* — Gardner Groff Greenwald & Villanueva, PC

(57) ABSTRACT

Systems and methods for flying sheet materials including a conduit, at least one airflow diverter and an outlet, and a fan positioned relative to the conduit for moving high velocity air through the conduit and out the at least one airflow diverter. In example embodiments, at least one sheet material is connected to a portion of the conduit and nearby the outlet such that the high velocity air provides a force against the sheet material causing the same to unfurl and fly as if an outdoor wind was present. In some example embodiments, two or more sheet materials can be unfurled or fly at the same time.

21 Claims, 28 Drawing Sheets

(56) References Cited

U.S. PATENT DOCUMENTS

| | | | | | |
|---|---|---|---|---|---|
| 2,270,753 | A | | 1/1942 | Fikes | |
| 2,284,209 | A | | 5/1942 | Holm | |
| 2,302,524 | A | | 11/1942 | Borregard | |
| 2,377,219 | A | | 5/1943 | Ellis | |
| 2,870,559 | A | | 1/1959 | Shaughnessy | |
| 3,477,161 | A | * | 11/1969 | Drexler | G09F 17/00 116/173 |
| 3,798,816 | A | * | 3/1974 | Flaherty | F04D 25/08 40/218 |
| 3,952,695 | A | | 4/1976 | Vollstedt | |
| 3,995,580 | A | | 12/1976 | Serrone | |
| 4,009,534 | A | | 3/1977 | Bradt | |
| 4,461,234 | A | | 7/1984 | Bounds | |
| 4,800,834 | A | | 1/1989 | Feng | |
| 5,042,418 | A | | 8/1991 | Hoover et al. | |
| 5,096,022 | A | | 3/1992 | Bowers | |
| 5,398,638 | A | * | 3/1995 | Bonk | G09F 17/00 116/173 |
| 5,427,050 | A | * | 6/1995 | Horn | G09F 17/00 116/173 |
| 5,509,371 | A | | 4/1996 | Phillips | |
| 5,572,835 | A | | 11/1996 | Atkins et al. | |
| 5,692,328 | A | | 12/1997 | Pettit | |
| 5,943,980 | A | | 8/1999 | Huang | |
| 5,975,009 | A | | 11/1999 | Nihra et al. | |
| 6,086,448 | A | | 7/2000 | Ibanez | |
| 6,622,649 | B1 | | 9/2003 | Shaw | |
| 7,017,510 | B1 | * | 3/2006 | Nair | G09F 17/00 116/173 |
| 7,432,820 | B1 | | 10/2008 | Phan et al. | |
| 7,788,832 | B2 | | 9/2010 | Yebenes De Madrid | |
| 8,215,807 | B1 | | 7/2012 | Brunesti | |
| 8,469,658 | B2 | | 6/2013 | Gammack et al. | |
| 8,604,729 | B2 | | 12/2013 | Clothier et al. | |
| 8,621,771 | B2 | | 1/2014 | Amalaha | |
| 8,973,517 | B1 | | 3/2015 | Bort | |
| 9,280,922 | B1 | * | 3/2016 | Chery | G09F 17/00 |
| 9,745,996 | B2 | | 8/2017 | Nurzynski | |
| 9,808,065 | B2 | | 11/2017 | Moloney et al. | |
| 2005/0241566 | A1 | * | 11/2005 | Piedmont | G09F 17/00 116/174 |
| 2006/0088292 | A1 | | 4/2006 | Guillen et al. | |
| 2007/0283875 | A1 | | 12/2007 | Durkin | |
| 2009/0019740 | A1 | | 1/2009 | Yebenes De Madrid, Jr. | |
| 2011/0094133 | A1 | | 4/2011 | Amalaha | |
| 2014/0345515 | A1 | * | 11/2014 | Lime | G09F 17/00 116/173 |
| 2016/0238038 | A1 | | 8/2016 | Hughes et al. | |

FOREIGN PATENT DOCUMENTS

| | | |
|---|---|---|
| CN | 103498588 | 1/2014 |
| CN | 103632623 | 3/2014 |
| EP | 1860632 | 11/2007 |
| JP | 2000276086 | 10/2000 |
| KR | 20040092348 | 11/2004 |
| KR | 20090091834 | 8/2009 |
| KR | 101353174 | 1/2014 |

* cited by examiner

SYSTEMS AND METHODS FOR FLYING SHEET MATERIALS

CROSS-REFERENCE TO RELATED APPLICATION

This application claims the benefit of U.S. Provisional Patent Application Ser. No. 62/454,744 filed Feb. 4, 2017, U.S. Provisional Patent Application Ser. No. 62/479,037 filed Mar. 30, 2017 and U.S. Provisional Patent Application Ser. No. 62/613,768 filed Jan. 5, 2018, the entireties of which are hereby incorporated herein by reference for all purposes.

TECHNICAL FIELD

The present invention relates generally to the field of flags and/or other sheet materials, and more particularly to systems and methods for providing an artificial wind producing assembly for displaying flags and/or sheet materials in an unfurled position as if a steady wind was present.

BACKGROUND

Continued improvements to flag poles and other systems and methods for producing an artificial wind to display a flag or sheet material in an unfurled configuration are sought. It is to the provision of systems and methods for flying sheet materials that the present invention is primarily directed.

SUMMARY

In example embodiments, the present invention provides systems and methods for flying sheet materials. In example embodiments, a wind or airflow generating device is provided for blowing air to cause the sheet material or flag to unfurl and generally expand and fly as if an outdoor wind was present.

In one aspect, the present invention relates to a system for flying sheet materials including at least one fan or blower, at least one conduit or pole, and at least one baffle for redirecting high velocity air produced by the fan or blower.

In another aspect, the invention relates to a flag flying system comprising at least one blower or fan and at least one sheet material, wherein the at least one blower or fan provides an airflow directed at the at least one sheet material such that the at least one sheet material becomes unfurled and generally flies as if an outdoor wind is present. In example embodiments, the flag flying system is provided for flying or unfurling flags indoors. In another example embodiment, the flag flying system is used for flying or unfurling flags outdoors when no outdoor wind is present.

In still another aspect, the invention relates to a method of flying or unfurling one or more flags comprising providing at least one fan or blower, providing at least one sheet material or flag, and outputting airflow from the at least one fan or blower towards the sheet material such that the at least one sheet material or flag becomes unfurled or flies as if an outdoor wind is present. In some example embodiments, the method further includes providing at least one sound absorption and/or dampening device and/or muffler to substantially reduce noise produced by the at least one blower.

In another aspect, the invention relates to a system for flying at least one sheet material including a conduit, at least one airflow diverter defined within a portion of the conduit, wherein an outlet is provided in the conduit and generally adjacent the airflow diverter, and a fan positioned relative to the conduit for moving high velocity air therethrough and out the at least one airflow diverter. In example embodiments, the at least one sheet material is connected to a portion of the conduit and nearby the at least one airflow diverter such that the high velocity air provides a force against the sheet material causing the same to unfurl.

In example embodiments, the conduit includes two airflow diverters spaced apart from each other. In example embodiments, a sound absorbing material can be in communication with the conduit. In example embodiments, the sound absorbing material is melamine foam. In example embodiments, the melamine foam is an open cell foam. In example embodiments, the sheet material is a flag. In example embodiments, the sheet material comprises indicia printed thereon. In example embodiments, the flag comprises polyester. In example embodiments, the sheet material is removably attached to a pair of repositionable coupling portions movably connected to the conduit. In example embodiments, the system is collapsible and includes a base for providing stability atop a ground surface. In example embodiments, the system is permanently mounted to a wall or suspended from a structure that is spaced a distance from the ground surface. In example embodiments, the system is powered by one or more batteries.

In another aspect, the invention relates to a system for flying sheet materials including a conduit, at least one baffle component defined within a portion of the conduit, wherein at least two outlets are provided in the conduit and generally adjacent the baffle component, and a fan positioned relative to the conduit for moving high velocity air therethrough and out the two outlets. In example embodiments, the at least two sheet materials are connected to a portion of the conduit and nearby the outlets such that the high velocity air is projected therefrom to provide a force against the sheet materials and causing the same to unfurl.

In example embodiments, the two sheet materials are configured for being unfurled in opposite directions. In example embodiments, the system comprises two baffle components including a first baffle component having two outlets and a second baffle component having two outlets. In example embodiments, a sound absorption material is provided to reduce the noise generated by the fan. In example embodiments, the system includes two fans and two baffle components.

In still another aspect, the invention relates to a system for flying sheet materials including a base housing defining an internal space, a blower positioned within the internal space of the base housing, one or more flag pole assemblies, and one or more conduit sections for connecting the one or more flag pole assemblies to the blower.

In example embodiments, the one or more flag pole assemblies are mounted to an exhibit structure, and wherein the one or more conduit sections provide communication between the flag pole assemblies and the blower such that high velocity air generated by the blower is output through the one or more conduit sections and out one or more outlet openings of each of the one or more flag pole assemblies to unfurl one or more sheet materials connected to the one or more flag pole assemblies. In example embodiments, at least one sound absorption material is provided for reducing the noise.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

Figure 1:
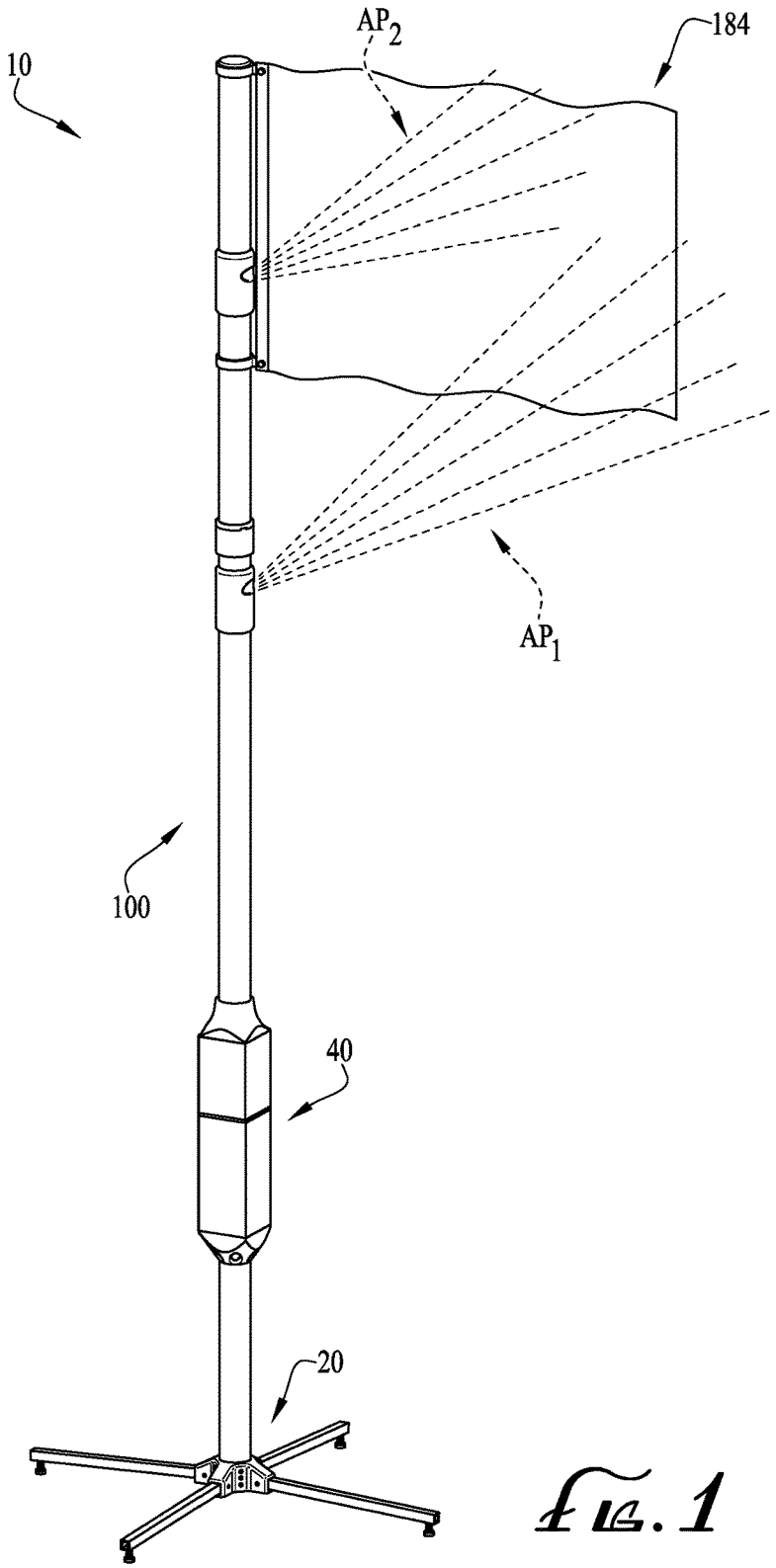
FIG. 1 shows a system for flying sheet materials according to an example embodiment of the present invention, and showing air being output from a pole assembly thereof and against the sheet material to cause the same to unfurl and fly as if an outdoor wind was present.

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

In example embodiments, the present invention provides systems and methods for providing an artificial wind-producing flag pole assembly for displaying a flag or sheet material in an unfurled position as if a steady wind was present. The systems and methods as shown throughout FIGS. 1-42 disclose a plurality of example embodiments of the systems and methods of the present invention. According to some example embodiments, the systems and methods as disclosed herein can preferably fly two or more flags or sheet materials in different directions at the same time.

According to some example embodiments, the present invention relates to flying a flag by directing high-speed air (that is generated by a blower or air mover) through an elongate pipe or flag pole and out one or more openings. The air being output from the openings are configured to pass by a sheet material or flag mounted to at least a portion of the pole, for example, whereby air exiting the one or more openings causes the expansion and waving of the flag as if outdoor wind is blowing the flag. In example embodiments, a flag flying system as disclosed herein is capable of flying one or more flags continuously indoors. In example embodiments, the flag flying system is substantially quiet without much of any noise, for example, measuring at between about 40-68 dBA.

In example embodiments and to provide context to the substantially reduced, if not entirely eliminated) noise levels of the systems as described herein, noise is measured in units of sound pressure levels called decibels using A-weighted sound levels (dBA) which are an expression of the relative loudness of sounds in air as perceived by the human ear. According to example studies and to provide comparison herein, the humming of a refrigerator is about 50 dBA, a normal conversation is approximately 60 dBA, a coffee shop or restaurant is about 75 dBA, and the noise from heavy city traffic can reach beyond 85 dBA. According to example embodiments, the systems for flying one or more sheet materials as disclosed herein is substantially quiet without much of any noticeable noise, for example, having a decibel reading of between about 40-68 dBA. According to some example embodiments, systems can be provided for example, which can have a much higher decibel reading. For example, according to example embodiments, in environment where the measured decibel reading is already large given an event, crowd, etc., less need for reduction in the noise levels, for example, up to a certain point as the measured decibel reading is at least above about 75-80 dBA.

FIGS. 1-6 show a system 10 for flying one or more sheet materials according to an example embodiment of the present invention. In example embodiments, the system 10 comprises a base 20, a blower assembly 40, a pole assembly 100, and a sheet material or flag 184 mounted to the pole assembly 100. In example embodiments, high speed air is generated by the blower assembly 40 and forced through the pole assembly 100 and out at least one opening to cause the sheet material to unfurl and expand, for example, to cause the sheet material 184 to fly as if an outdoor wind was present. According to one example embodiment, two openings are provided on the pole assembly 100 such that both a first airstream AP1 and a second airstream AP2 are output from the pole assembly 100 to cause unfurling and flying of at least one sheet material 184 mounted thereto (see FIG. 5).

Figure 2A:
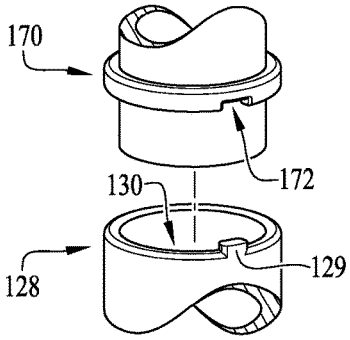
FIG. 2A shows a detailed perspective view of a portion of the system of FIG. 2.
Figure 2B:
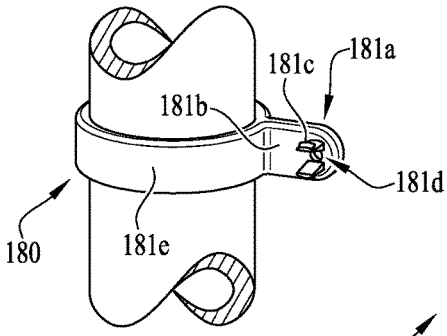
FIG. 2B shows a detailed perspective view of another portion of the system of FIG. 2.
Figure 2:
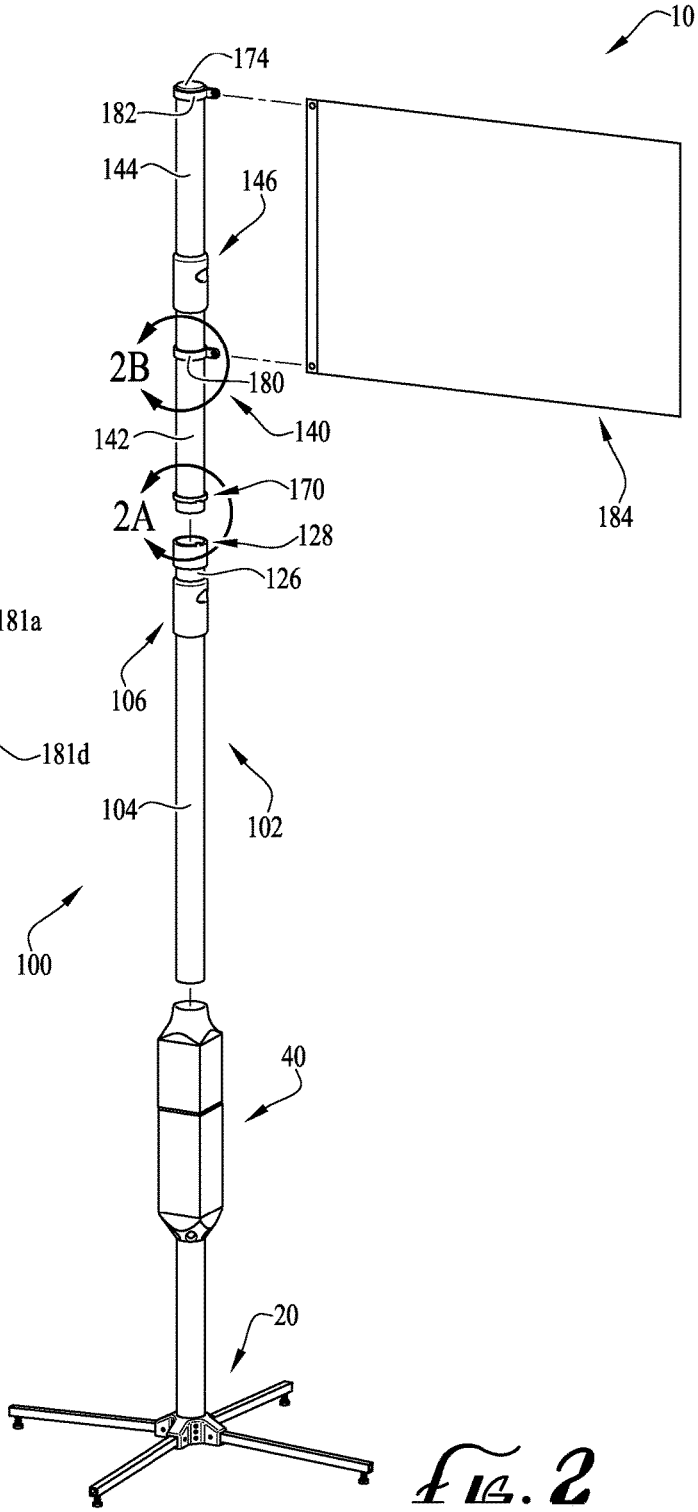
FIG. 2 shows the system of FIG. 1 with the pole assembly disconnected therefrom.
Figure 5:
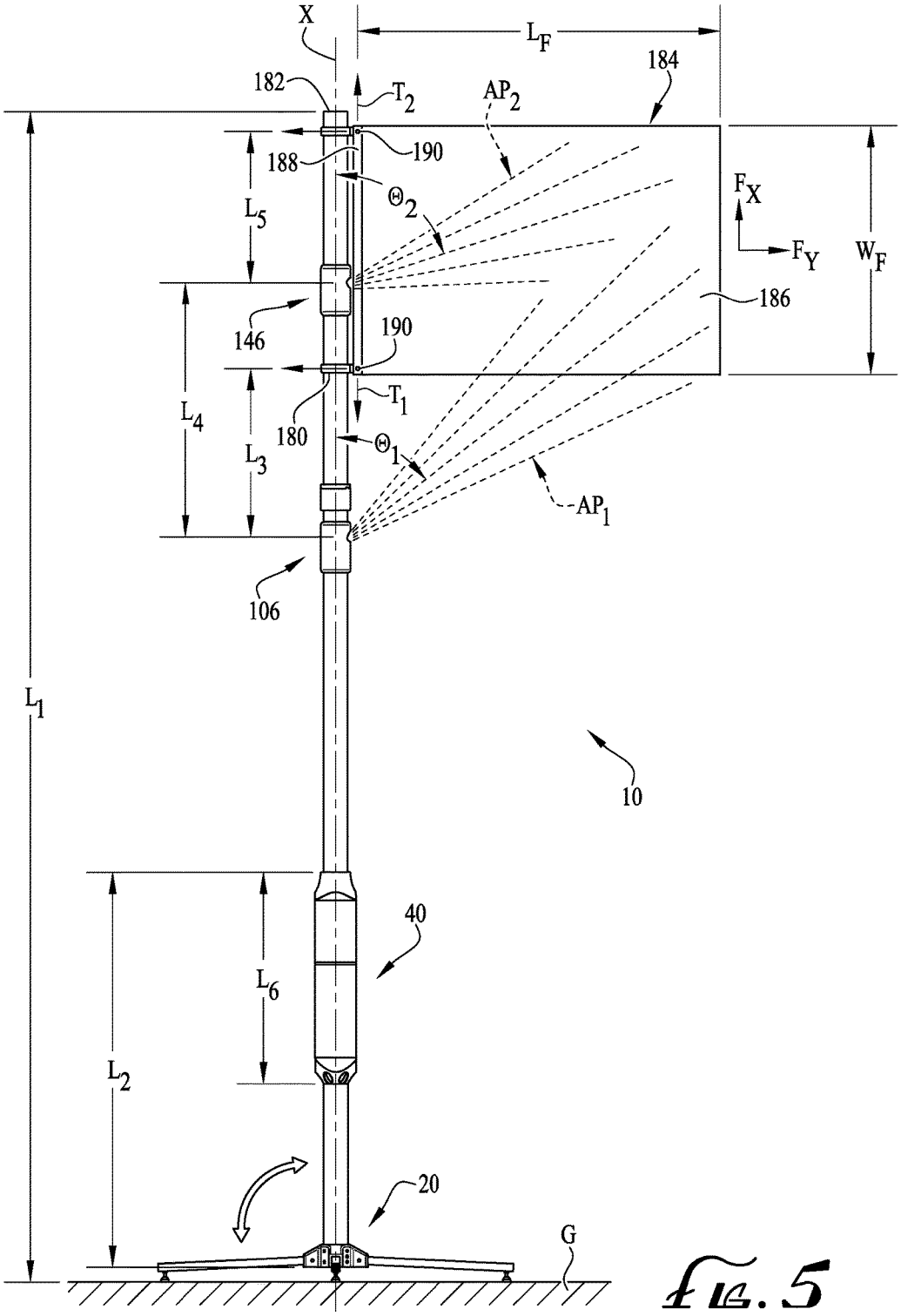
FIG. 5 is a side plan view of the system of FIG. 1, and showing the direction of the airflow exiting the conduit and against the sheet material to unfurl the same.

As depicted in FIG. 2, the pole assembly 100 comprises two connectable assembly sections 102, 140, which when assembled with the blower assembly 40 and base 20 extend about 9.5 feet from a ground surface G supporting the system 10 and defining a first length L1 (see FIG. 5). In alternate embodiments, the pole height can be adjusted as desired. For example, according to one example embodiment, the pole height is about 7.5 feet when assembled with the base and blower assembly, and thereby the system can be used in an indoor space with ceilings of about 8 feet tall. Optionally, the first length L1 can be shortened or lengthened as desired. According to other example embodiments as will be described below, the system can be permanently or removably mounted to a wall at a desired height from the ground surface. Further described herein, one or more systems can be suspended from the ceiling to a desired height from the ground surface.

Figure 13:
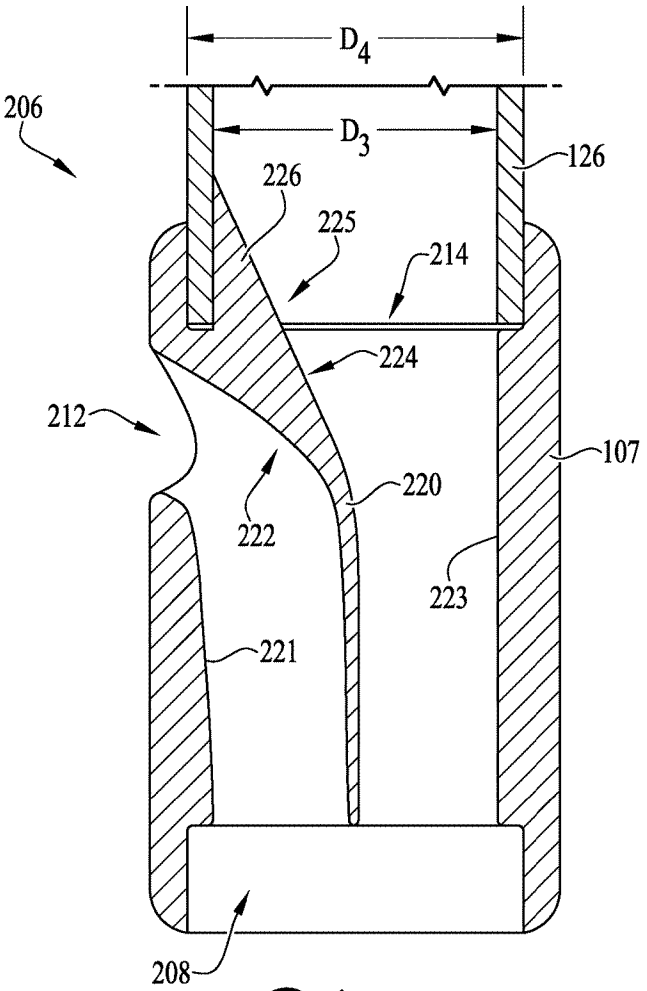
FIG. 13 is a cross-sectional view of a first baffle component according to another example embodiment of the present invention.
Figure 17:
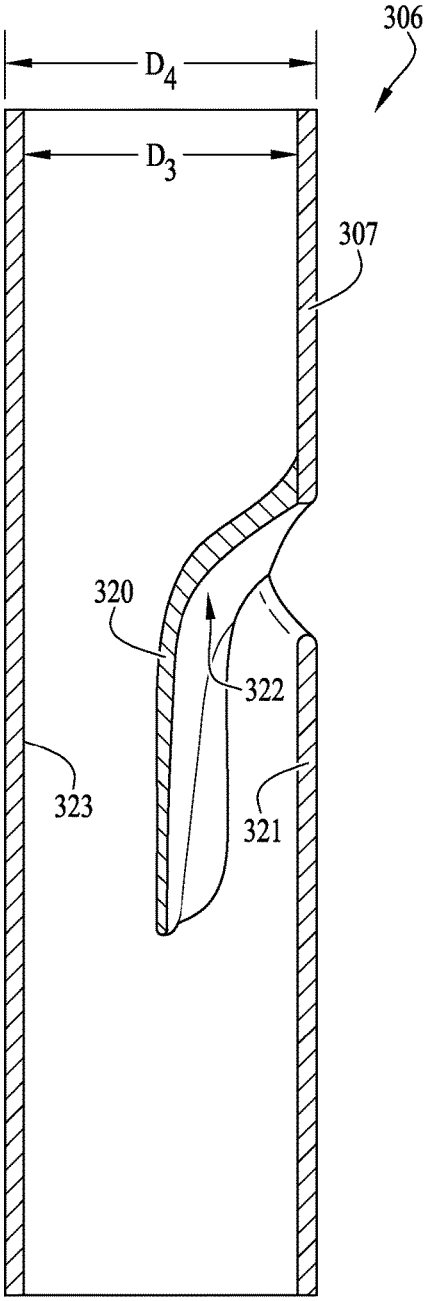
FIG. 17 is a cross-sectional view of the conduit section of FIG. 16.

In example embodiments, the pole assembly and other pole sections or conduits as described here are formed from a structural aluminum comprising an inner diameter of about 2 inches and an outer diameter of about 2.37 inches (see D3 & D4 in FIGS. 13 and 17. Optionally, the pole or conduit as disclosed herein can be formed from other metals, plastics (PVC), composites, extruded rubber tubing, natural or synthetic materials, or combinations thereof.

In example embodiments and as depicted in FIG. 2, the pole assembly 100 comprises a lower section 102 and an upper section 140. In example embodiments, the lower section comprises a pole section 104, a baffle 106, and intermediate pole section 126, and a coupling 128. The upper section 140 comprises a first pole section 142, a second pole section 144 and a baffle 146. In example embodiments, a pair of connectors 180, 182 extend from the pole for providing removable engagement with the flag 184 and a cap 174 is attached to an end of the second pole section 144.

As depicted in FIG. 2A, the coupling portion 128 comprises an alignment protrusion 129 on an upper end of a receiver 130 defined therein. In example embodiments, the receiver 130 is configured for providing a frictional fit with a lower end of the first pole section 142, and wherein a mating alignment ring 170 (comprising a receiver 172) is mounted to fittingly engage with the protrusion 129 of the coupling portion 128. Thus, as the baffles 106, 146 are not on the same pole section of the pole assembly 100, the engagement of the protrusion 129/receiver 172 when connecting the two together provides alignment thereto and ensures that the openings are directed in the same direction. Optionally, a plurality of other connectors, features, methods can be provided for connecting the pipe sections together and/or provide for a removable connection with the baffles 106, 146. For example, ends of the pole can be turned on a lathe and cut to provide a male/female engagement. According to one example embodiment, the pipe comprises an inner diameter D3 of about 2 inches and an outer diameter D4 of about 2.37 inches (see FIG. 13). Thus, an outer diameter of one of the pole sections can be reduced by about half the thickness of the pole along the outer surface thereof and the other of the pipe sections can be turned, for example, such that about half the thickness of material is removed from an interior portion of the other pole section. According to another example embodiment, to provide both alignment and removable engagement, one or more bayonet connections can be provided, for example, wherein one or more protrusions from one of the engagement ends provides movable engagement within a channel of the mating engagement end such that the two are removably connected and aligned as desired. According to another example embodiment, one of the end can be reduced for example, to comprise an outer diameter at least the same if not less than the inner diameter of the connecting pole. Optionally, a plurality of other connectors and systems can be used for connecting the poles together. As depicted in FIG. 2B, the connector 180 comprises an extension portion 181*a* defining a generally rigid arm 181*b*, and a pair of clips 181*c* extend from the arm 181*b* for providing removable engagement with the flag 184. In some example embodiments, an opening 181*d* is defined through the arm 181*b*. In some example embodiments, a mounting portion 181*e* can be provided for attachment to one or more pole portions. In example embodiments, the connectors 180, 182 are preferably positionable along the pole as desired, for example, to generally retain an edge of the flag 184 generally near the pole and in a direction such that the at least one airstream exiting the pole can project in a direction to cause the flag to unfurl and fly as if an outdoor wind was present. According to some example embodiments, the connectors 180, 182 are configured such that the flag is mounted to the pole to cause the least amount of drag and friction against the airstreams exiting the pole. Optionally, according to other example embodiments of the present invention, one or more other connectors, clips, clamps, clasps, magnets, couplings, etc. can be provided for connection of the flag 184 to the pole assembly 100. In some example embodiments, a magnetic connector can be provided for attachment of the flag 184 to the pole assembly 100. According to other example embodiments, the connector is preferably configured such that at least one edge of the flag 184 is generally tensioned tightly when mounted thereto.

Figure 3:
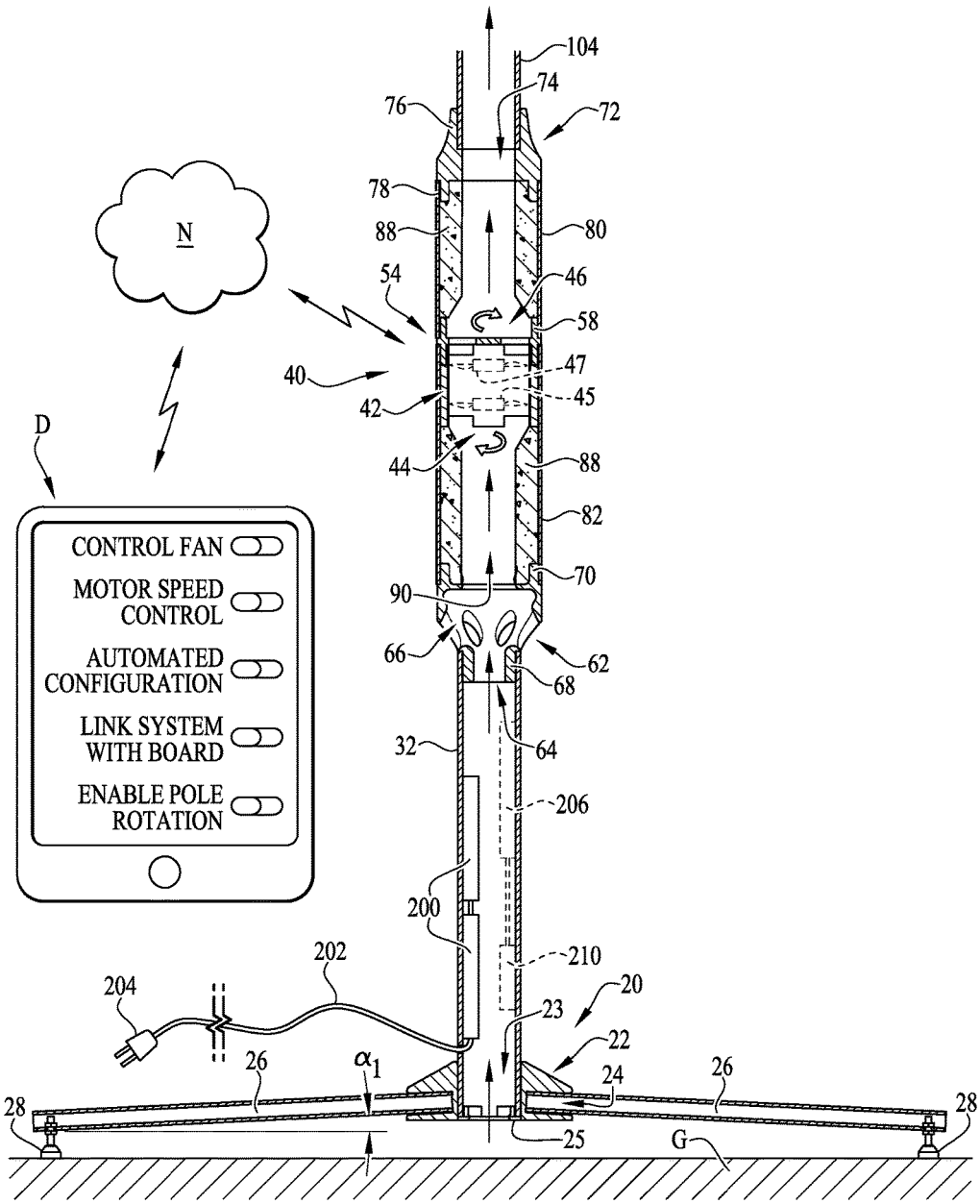
FIG. 3 shows a cross-sectional view of the base assembly of FIG. 2.
Figure 4:
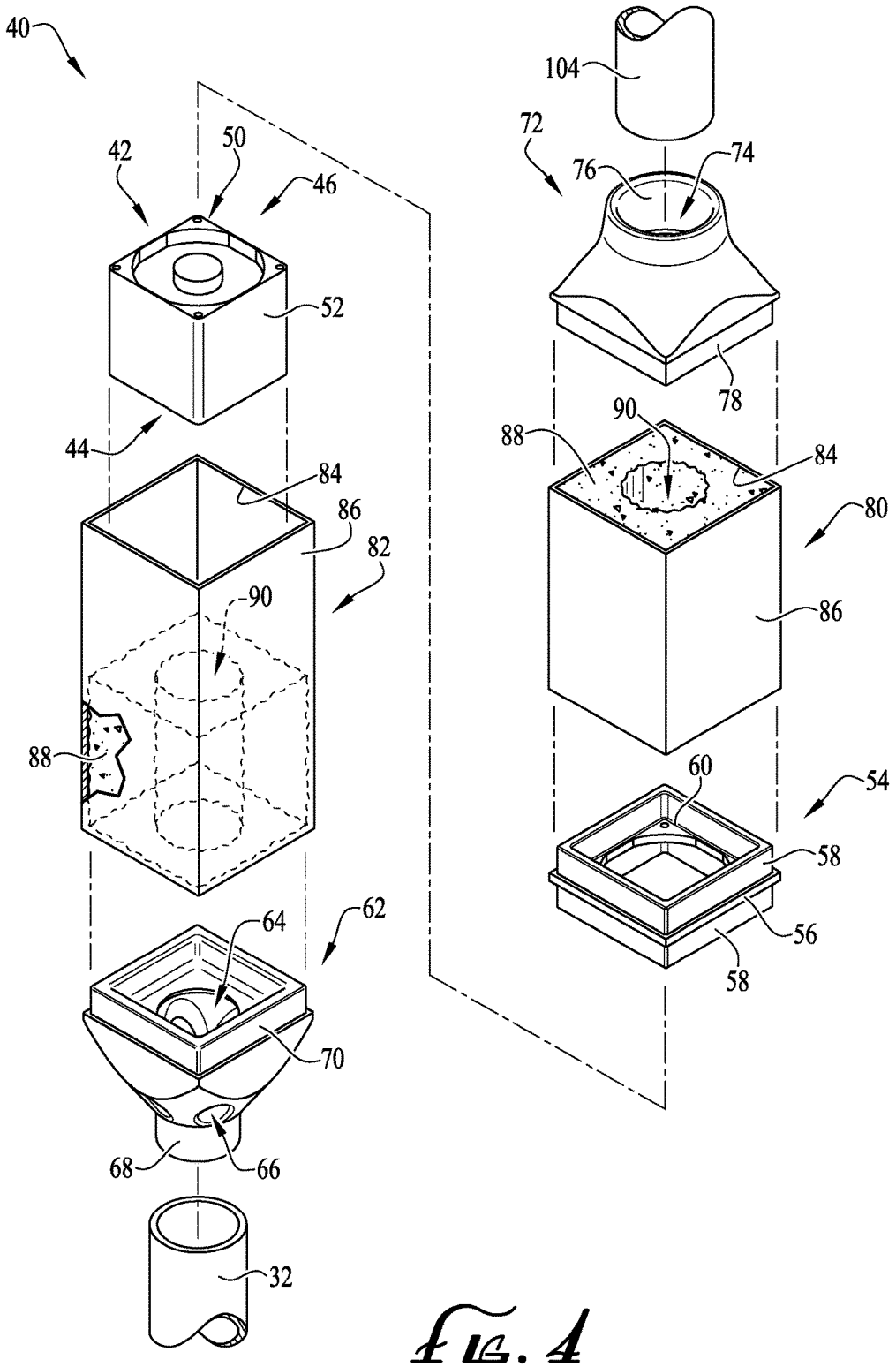
FIG. 4 shows a perspective assembly view of the blower assembly of FIG. 3.

As depicted in FIGS. 3-4, the base assembly 20 and blower assembly 40 are generally connected thereabout in some manner, for example, to support the system and provide concealment to the power supply, etc. According to example embodiments, the base 20 comprises a central coupling 22, a central conduit 23, a plurality of receivers 24 (for receiving legs 26), and an optional cap 25. In example embodiments, the legs 26 comprise feet 28, and the legs 26 generally extend at a downward angle (see angle $\alpha$1), for example, about 3-12 degrees, to allow for air to be drawn through the central conduit 23 of the coupling 22 and to keep a bottom portion of the coupling 22 from contacting the ground surface G.

In example embodiments, the pipe section 32 connects the base 20 to the blower assembly 40, and also houses the power supply 200 for connecting the system 10 (via cord 202 and plug 204). Optionally, other components can be housed within a portion of the base, for example, a controls module 210 and/or a rechargeable battery supply, for example, such that the cable be not needed for powering the system 10. For example, according to some example embodiments, the controls module 210 can be configured for connection/communication with a wireless network N (e.g., over Wi-Fi), for example, such that an electronic device D or other tablet or control device can control operation of the system 10. In some example embodiments, functions such as controlling the fan, it's speed, automated mode, pole rotation, etc. can be controlled via the device and over the network. Optionally, other forms of communication and connectivity such as Bluetooth, IR, RF and/or other various forms of connectivity can be provided for wireless operation. According to some example embodiments, a plurality of systems 10 can be linked together for remote control operation. In other example embodiments, one or more systems 10 can be connected with an electronics board (e.g., sound board) or other electronics monitor/system such that wireless and on-demand operation can be provided.

In example embodiments, the blower assembly 40 comprises a blower or fan component 42, a fan mounting member 54, a first end coupling portion 62, a second end coupling portion 72, and first and second housing components 80, 82. In example embodiments, the fan 42 comprises a counter rotating fan, for example, comprising a first fan blade 45 at an inlet 44 of the fan 42 and a second fan blade 47 at an outlet 46 of the fan 42. In example embodiments, the first fan blade 45 rotates in a first direction (see rotation arrow) drawing air in the inlet 44 and the second fan blade 47 rotates in a second direction (see rotation arrow) forcing the air out the outlet 46 and further up the pole assembly 100. In example embodiments, the fan 42 is generally rated for 12 volts (operating range of between about 10.8-13.2 V) and comprises a max airflow of about 194 CFM. According to one example embodiment, the fan 42 comprises a San Ace 80 counter rotating fan. Optionally, other blowers, fans, and/or other air-moving devices can be provided as desired.

According to one example embodiment, other fans or blowers can be used, for example, a brushless DC motor and impeller, for example, which can cause rotation of the motor shaft to reach speeds at or above 110,000 RPM. Thus, according to some example embodiments, a digital motor (having neodymium magnets), for example, wherein a digital pulse is provided to electronically control the brushless motor to provide an impeller rotation of about 25,000 RPM, or for example, at speeds of about 110,000 RPM or greater. U.S. Published Patent Application No US 2017/0310249 to Dyson Technology Limited discloses a method for controlling an electric motor and is incorporated by reference herein in its entirety. According to some example embodiments, with the capability of the brushless DC motor rotating substantially quicker, one or more motors with a much smaller footprint can be incorporated in the systems as described herein.

In example embodiments, the fan component 42 is mounted to the fan mounting member 54, and the fan mounting member 54 is connected between the first and second housing components 80, 82. The first end coupling portion 62 couples to an end of the second housing component 82 and the second end coupling portion 72 couples to an end of the first housing component 80. According to example embodiments, a sound absorbing material 88 is provided within the first and second housing portions 80, 82, for example, such that a substantial amount of noise generated by the fan 42 and the airflow is reduced. For example, in example embodiments, the sound absorbing material 88 comprises porous and open-cell melamine foam, for example, defining a central conduit that is generally aligned with the inlet 44 and outlet 46 of the fan 42. In example embodiments, the material 88 forms an inlet conduit and an exit conduit, for example, such that noise from the fan 42 can be absorbed to its maximum extent. For example, noise attempting to exit from the inlet and/or outlet side of the blower assembly will be exposed to the sound absorbing material 88, for example, such that a substantial majority thereof will be absorbed and such that the overall audible noise levels are reduced. For example, as described above, the measured noise of the system while powered and generating high speed air to unfurl the flag is between about 40-68 dBA.

In example embodiments, the first end coupling 62 comprises a central opening or conduit 64, one or more inlet openings 66, a lower coupling 68 for connecting with the pole 32, and an upper coupling 70 for connecting with an end of the second housing component 82. The fan mounting member 54 comprises a central or lip member 56, a pair of connecting ends 58, and an inner mounting portion 60 for providing a mounting surface for a portion of the fan 42. The second end coupling 72 comprises a central opening 74, an upper coupling portion 76, and a lower coupling portion 78. As depicted in FIG. 3, the sound absorbing material transitions near the inlet 44 and outlet 46 of the fan 42. Preferably, the length of the transition can be chosen as desired. According to one optional embodiment, a rubber dampening gasket or flange can be provided between the connection of the fan 42 and the fan mount 54. According to some example embodiments, one or more portions of the fan assembly and/or other portions of the system can comprise a sound dampening material, for example, in addition to the sound absorbing material. According to yet another example embodiment, at least a portion of the conduit defined within the pole sections can comprise an absorption layer defined along an interior thereof. In some example embodiments, thinly chopped melamine foam or other sound absorption materials can be applied to an inner surface of pole portions, for example, to further increase the amount of noise absorption.

In example embodiments as described above, the total height of the assembled system 10 is about 9.5 feet (see L1). Optionally, a height less or more than 9.5 feet can be provided. A length L2 is defined between a bottom portion of the coupling 22 and an end portion of the blower assembly 40, for example, which is about 38.5 inches. A length L3 is defined between a bottom edge of the flag 184 and an opening 112 of the first baffle 106, a length L4 is defined between the opening 112 of the first baffle 106 and an opening 154 of the second baffle 146, a length L5 is defined between the opening of the second baffle 146 and a lower edge of the flag 184, and a length L6 defines the extension of the blower assembly 40. In example embodiments, the length L2 is between about 4-60 inches, for example about 38.5 according to one example embodiment. The length L3 is between about 3-30 inches, for example, about 16.5 inches according to one example embodiment. The length L4 is between about 6-50 inches, for example, about 25 inches according to one example embodiment. The length L5 is between about 3-35 inches, for example, about 16 inches according to one example embodiment. The length L6 is between about 3-45 inches, for example, about 21 inches according to one example embodiment.

Figure 15:
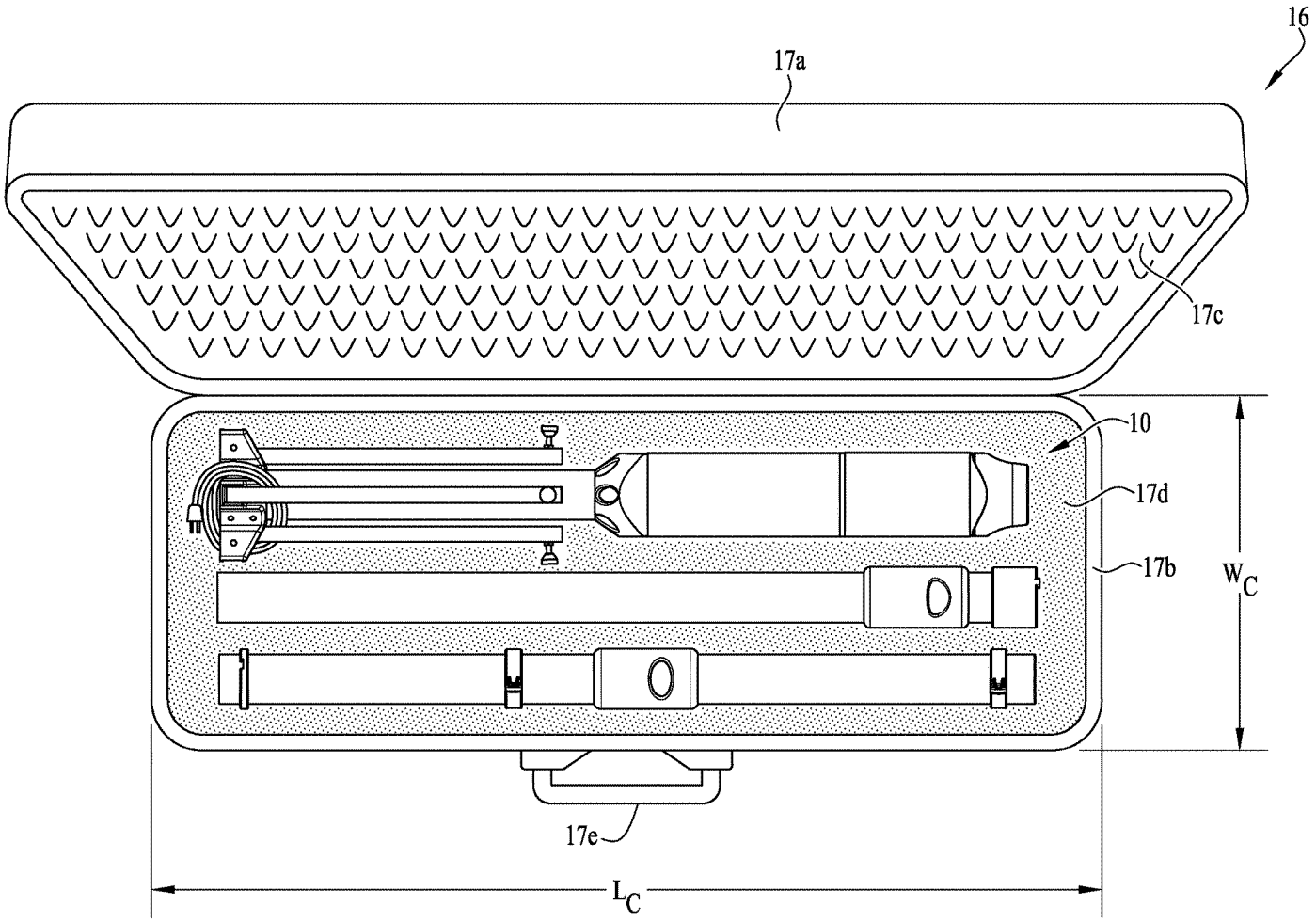
FIG. 15 shows the system of FIG. 1 disassembled and contained within a carrying case according to another example embodiment of the present invention.
Figure 16:
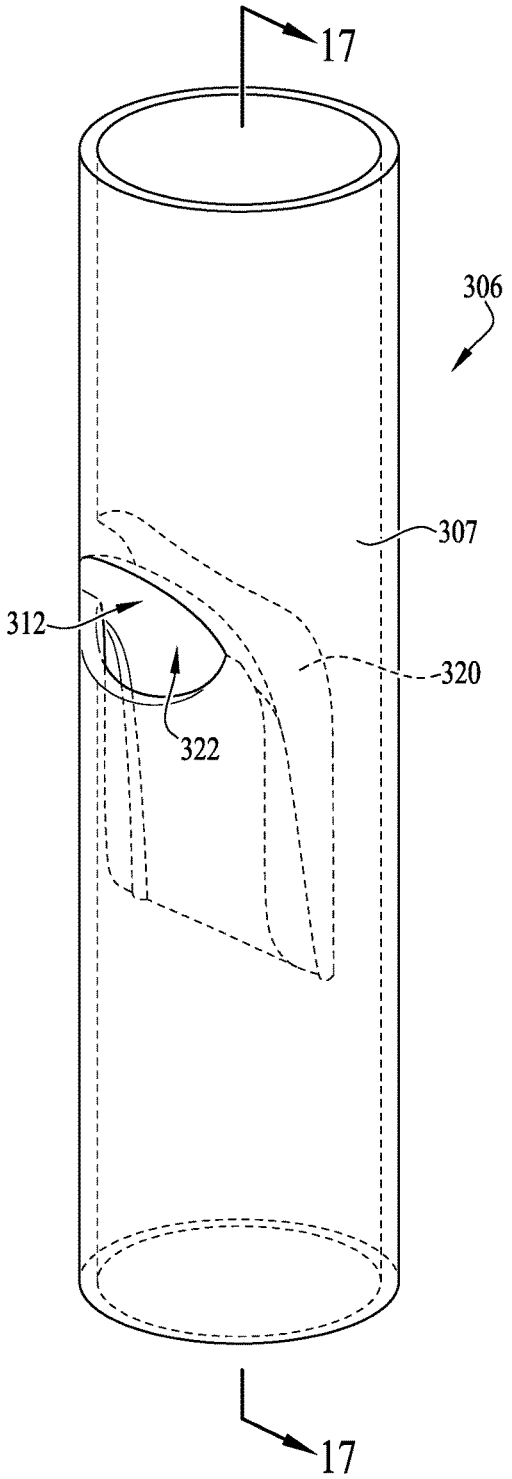
FIG. 16 is a perspective view of a conduit section comprising an internal baffle member and opening formed thereby for allowing air to pass therethrough and against the sheet material to unfurl the same.

As depicted in FIG. 15, the system 10 can be disassembled and stored within a carry case 16, for example, comprising housing shells 17*a*, 17*b* and padding or support liners 17*c*, 17*d* fitted within the shells 17*a*, 17*b* for protecting the system 10 during storage and transport. Optionally, a carrying handle 17*e* and/or one or more wheels or other carrying/transportation assisting components can be provided as desired. According to some example embodiments, the legs 26 can be configured for folding relative to the pipe 32/coupling 22, for example, to provide for easily moving the legs between an expanded configuration and a collapsed configuration for storage or transport (e.g., and for storing in case 16). According to example embodiments, the case 16 comprises a length LC and a width WC. In example embodiments, the length LC and width WC are configured such that the case 16 comprises interior dimensions of about 41 inches in length, 14 inches in width, and a thickness of about 5.5 inches. In example embodiments, the length LC is about 44 inches and the width WC is about 17 inches. Optionally, other dimensions may be chosen as desired. According to another example embodiment, the case 16 can be in the form of a cylinder comprising a closed end and a top for enclosing the case, for example, wherein the entirety of the system 10 is fitted therein for storage or transport.

Referring back to FIG. 5, the first airstream AP1 exiting from the outlet 112 of the first baffle 106 projects upwards at an angle 81 relative to an elongate axis X that is defined and axially aligned with the extension of the pole assembly 100. And the second airstream AP2 exits from the outlet 154 of the second baffle 146 at an angle 82 relative to the elongate axis X. In example embodiments, the first airstream AP1 projects at an angle of between about 2-90 degrees relative to the axis, for example, between about 23-27 degrees relative to the axis X. According to one example embodiment, the angle 81 of the first airstream AP1 is about 25 degrees. In example embodiments, the second airstream AP2 exits an angle of between about 5-95 degrees, for example, between about 75-89 degrees relative to the axis X. According to one example embodiment, the angle 82 of the first airstream AP1 is between about 80-87 degrees, for example, about 86 degrees according to one example embodiment. Optionally, the projection angles of the airstreams AP1, AP2 can be chosen as desired. For example, according to one example embodiment, depending on the dimensions of the flag that is to be flown, the projection angles can be adjusted accordingly to provide sufficient airflow in the proper direction (and engaging the proper portion of the flag).

According to one example embodiment, to fly a flag comprising a length LF of about 3 feet and a width WF of about 2 feet, the velocity of the air exiting the outlet openings of the baffle components is between about 35-55 mph. For example, according to one example embodiment, to fly a flag comprising 150D polyester (and any desired printed indicia thereon), the air velocity exiting the outlet openings is generally between about 35-40 mph. According to one example embodiment, the air velocity is about 41 mph.

Figure 6:
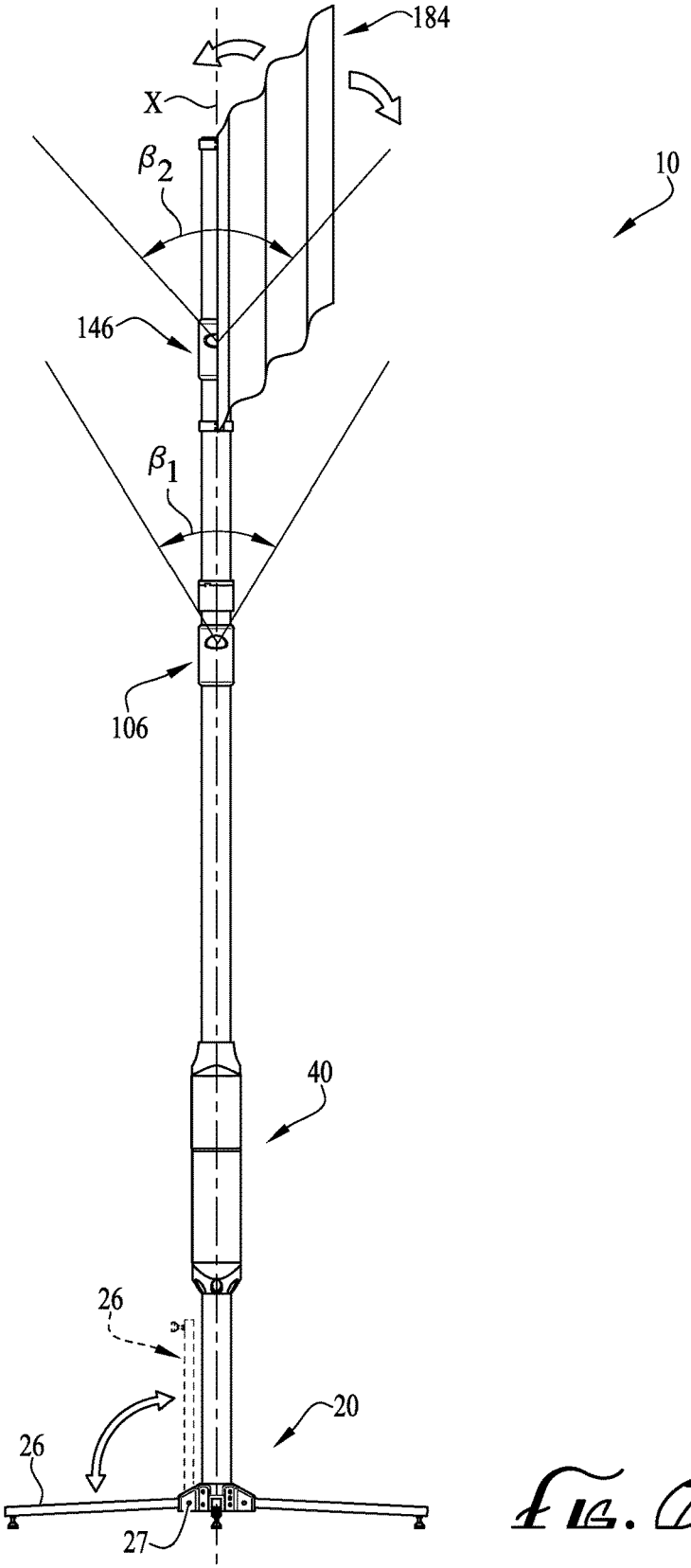
FIG. 6 is a front plan view of the system of FIG. 5.
Figure 7:
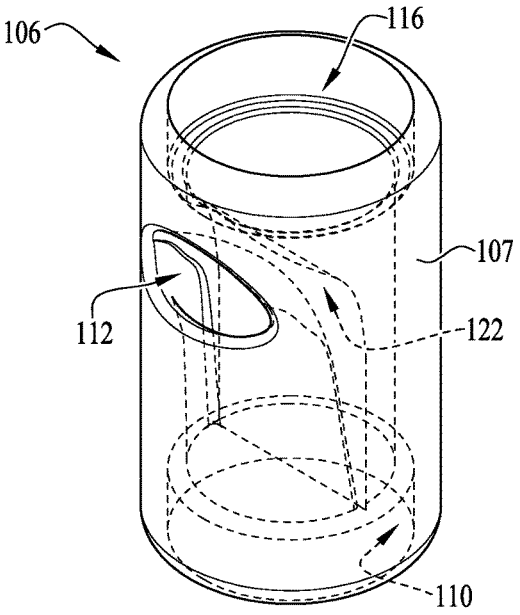
FIG. 7 is a perspective view of a first baffle component according to an example embodiment of the present invention, wherein hidden portions thereof are shown in dashed lines.
Figure 8:
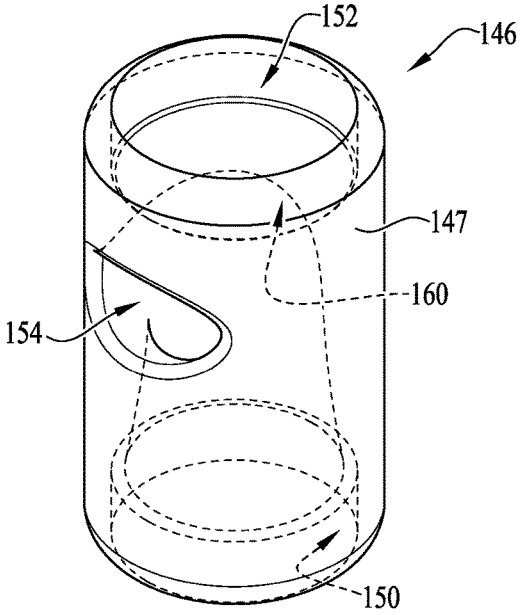
FIG. 8 is a perspective view of a second baffle component according to an example embodiment of the present invention, wherein hidden portions thereof are shown in dashed lines.
Figure 9:
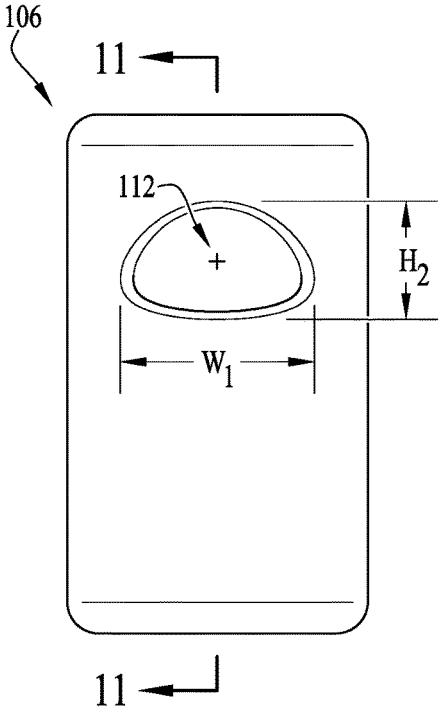
FIG. 9 is a front plan view of the first baffle component of FIG. 7.
Figure 10:
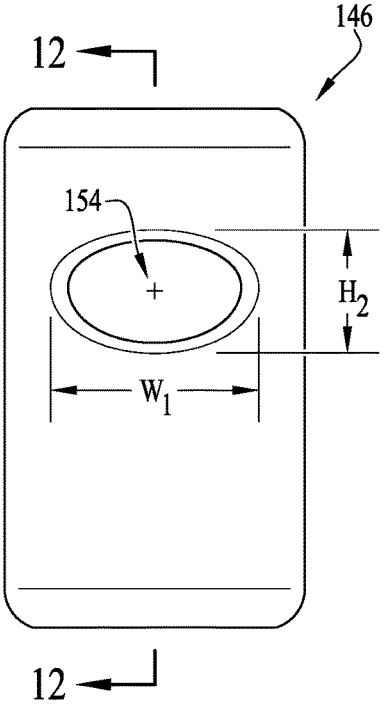
FIG. 10 is a front view of the second baffle component of FIG. 8.
Figure 12:
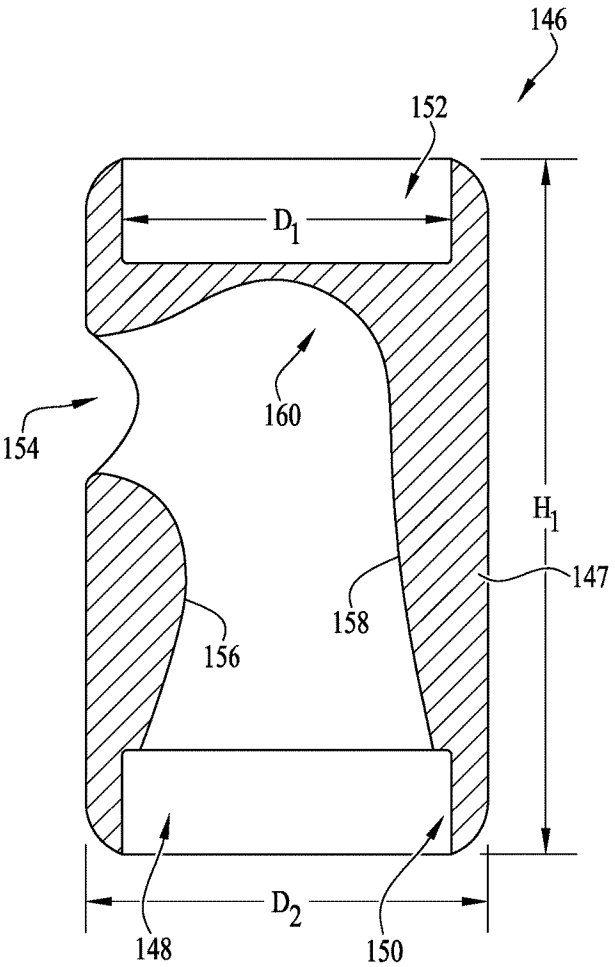
FIG. 12 is a cross-sectional view of the second baffle component of FIG. 10.
Figure 11:
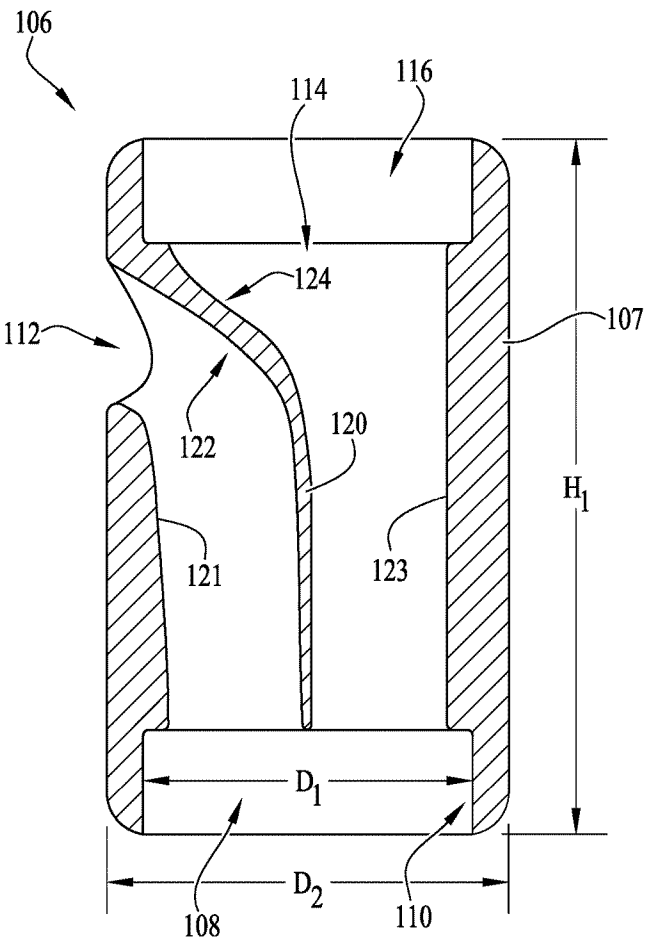
FIG. 11 is a cross-sectional view of the first baffle component of FIG. 9.

In example embodiments, the flag 184 comprises a printed portion 186 and a mounting or hoist portion 188, and a pair of spaced apart grommets 190 positioned on the hoist portion for removable engagement with the clips 181*c* of the couplings 180, 182. In example embodiments, the couplings 180, 182 preferably cause the mounting portion 188 to be tensioned (see T1 & T2), and the first and second airstreams AP1, AP2 apply a positive force in both the horizontal and vertical components against both sides of the flag 184 (seen as upwards and to the right—see force arrows) to cause the same to unfurl and fly as if an outdoor wind was present. In example embodiments, the couplings 180, 182 preferably rigidly retain the mounting portion 188 to maintain the flag 184 in a substantially unfurled and expanded configuration. As depicted in FIG. 6, the first and second airstreams AP1, AP2 comprise angles β1, β2 that define the spread of the airstreams as they discharge to engage the flag 184. In example embodiments, the angles β1, β2 are generally between about 8-45 degrees, for example, between about 10-35 degrees according to example embodiments. According to one example embodiment, the angles β1, β2 are about 28 degrees. According to one example embodiment, at about 5 inches from the outlet 112 of the baffle 106, the width of the airstream AP1 is about 5 inches. Optionally other angles can be chosen as desired. Preferably, by outputting the airstreams AP1, AP2 in the present manner, the flag 184 remains unfurled within a boundary of the limits of the airstream spread.

FIGS. 7-12 show the baffles 106, 146 in greater detail. In example embodiments, the baffles 106, 146 comprise a height H1 of about 5 inches. In example embodiments, the baffle 106 comprises a generally elongate member 107, an inlet 108, a first coupling portion 110, an outlet opening 112, a second outlet 114, and a second coupling portion 116. In example embodiments, a divider or baffle member 120 is provided within the member 107 (generally positioned at a central portion therein) and extends upwards to define an upper portion of the outlet 112. In example embodiments, the divider 120 causes air passing therethrough to be divided into a first portion for exiting out of the outlet 112 and a second portion for passing through the outlet 114. The air passing through the first portion is bound by an inner surface 121, a surface of the divider 120, and a transition portion 122 before being output therefrom in an outward and upward direction to engage the flag 184. The air passing through the second portion is bound by an inner surface 123, the divider 120, and a transition portion 124. Preferably, the surfaces and transitions are configured to assist in laminar airflow without any turbulence. In example embodiments, the transition 122 is configured to output the airstream AP1 at an angle of about 25 degrees relative to a vertical axis. The transition 124 is preferably provided such that airflow passing through the second portion is less likely to become turbulent as it continues to flow upwards.

The baffle 146 comprises a generally elongate member 147, an inlet 148, a first coupling portion 150, an outlet opening 154, and a second coupling portion 152. For example, rather than permitting additional airflow to pass therethrough (as depicted in the baffle 106), the baffle 146 is configured such that all the air passing therethrough exits from the outlet opening 154. In example embodiments, the baffle 146 comprises inner surfaces 156, 158, and a transition portion 160, which together, act to guide the airflow therein to exit from the outlet 154 and against the flag 184. Referring back to FIGS. 9-10, the outlet opening 112 of the baffle 106 is generally circular or oval-like in shape, for example, comprising a width W1 and a height H2, for example, wherein the width W1 is between about 0.5-6 inches and a height H2 of between about 0.5-6 inches. According to one example embodiment, the width W1 is between about 1.5-1.9 inches and the height H2 is between about 0.75-1.5 inches, for example, a width W1 of 1.8 inches and a height H2 of 1 inch according to one example embodiment. In example embodiments, the outlet opening 154 of the baffle 146 is similarly generally circular or oval-like in shape, for example, comprising a width W1 and a height H2, for example, wherein the W1 is between about 0.5-6 inches and a height H2 of between about 0.5-6 inches. According to one example embodiment, the width W1 is between about 1.5-2.5 inches and the height H2 is between about 0.75-1.5 inches, for example, a width W1 of 1.9 inches and a height H2 of 1 inch according to one example embodiment. Optionally, the outlet openings 112, 154 can be sized and shaped as desired.

Figure 14:
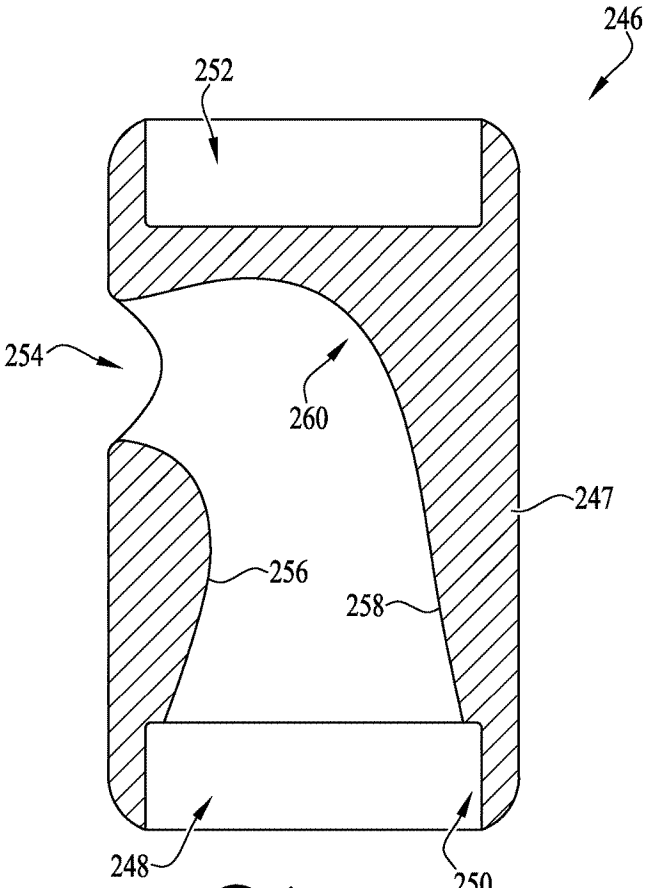
FIG. 14 is a cross-sectional view of a second baffle component according to another example embodiment of the present invention.

FIGS. 13-14 show additional baffle components according to additional example embodiments of the present invention. For example, the baffle 206 comprises an extended transition portion 225 comprising a projection 226, for example, to further assist the airflow passing through the second portion thereof (e.g., eliminating the likelihood of turbulent airflow). As depicted in FIG. 14, the transition portion 260 is less severe and drastic than the transition portion 160 of baffle 146. Preferably, the internal surfaces, transition portions or other portions of the baffle(s) can preferably be provided such that air flows (e.g., output) from the outlet in a desired direction, for example, and comprising a desired spread and throw (e.g., horizontal and vertical axial distance the air stream travels after leaving the outlet and before the maximum stream velocity is reduced to a specified terminal velocity) to cause the flag to unfurl and fly as if an outdoor wind was present.

In other example embodiments, the baffle components can take on other shapes and/or forms for outputting the air in a desired direction to fly one or more flags. In some example embodiments, one or more vanes can be provided (to assist in directing the same) such that the flow is substantially if not entirely laminar as it exits the outlets of the top and bottom baffles. According to example embodiments, rather than having two baffle components and utilizing one conduit (which is split into two), one of ordinary skill in the art would understand that individual conduits of air can be provided along any desired number of positions along the flag, for example, and directed at any desirable orientation, to fly the flag. In some example embodiments, a fan is provided below one of the baffle components and another fan is provided below the other baffle component. Optionally, according to another example embodiment, a first fan is provided for a first baffle component and a second fan is provided for a second baffle component. As will be described below, the fan, direction of airflow, and baffle configuration can be chosen as desired.

Figure 18:
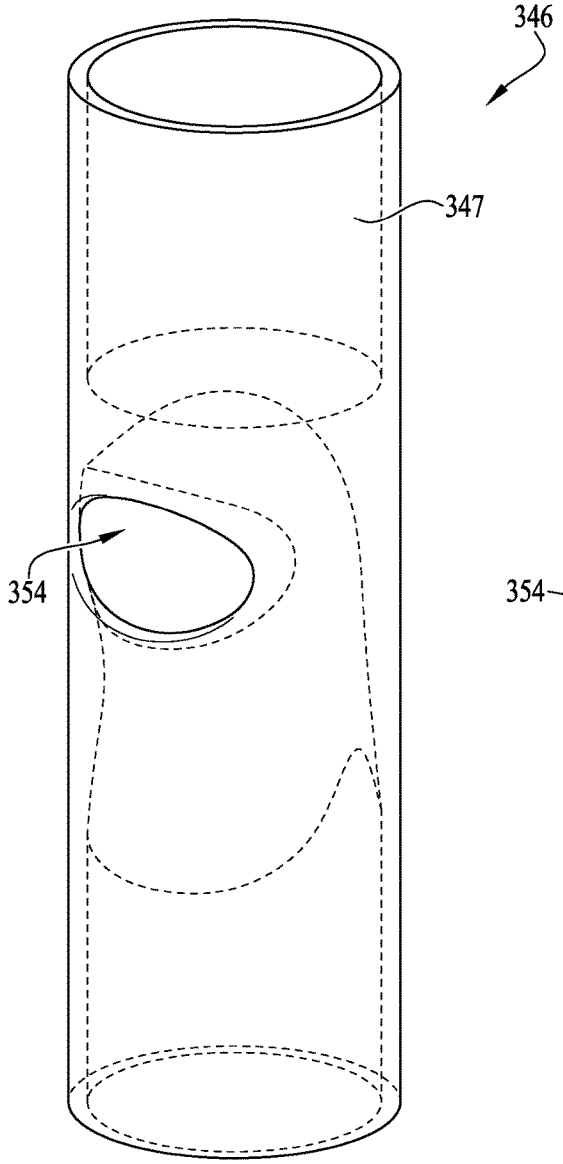
FIG. 18 is a perspective view of a conduit section comprising an internal baffle member and opening formed thereby for allowing air to pass therethrough and against the sheet material to unfurl the same.
Figure 19:
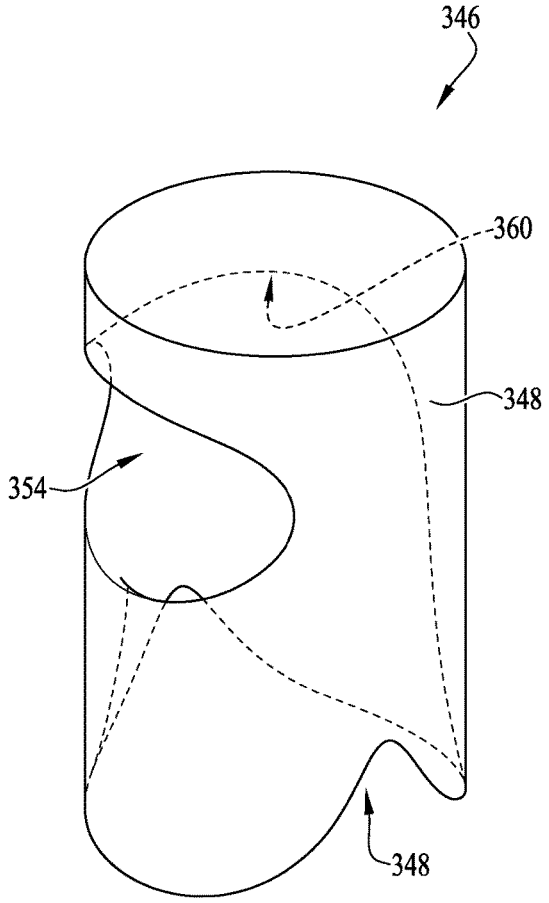
FIG. 19 is a perspective view of the internal baffle member of FIG. 18.

FIGS. 16-19 show baffle components according to additional example embodiments of the present invention. In example embodiments, rather than the baffles providing for connection with the ends of pole sections, preferably the baffle components can be incorporated within the pole sections. For example, a pole section 306 comprises an elongate pole 307 and a baffle component configured for mounting within the pole and generally adjacent an opening 312 formed in the pole 307. In example embodiments, the baffle component is generally similar to the baffle component 106 as described above. In example embodiments, the baffle component is a separate piece and generally permanently mounted within the pole 307. Optionally, the baffle component can be integrally formed with the pole 307. FIGS. 18-19 show another baffle component 346, for example, which is generally similar to the baffle 146 as described above. In example embodiments, the baffle component 346 is preferably a separate piece that can be mounted within a pole section 347 and generally adjacent an outlet 354. In example embodiments, the baffle component 346 is a separate piece and permanently coupled within the pole section 347. Optionally, the baffle component 346 is integrally formed with the pole section 347. Optionally, the baffle components can be sized, shaped, and configured as desired.

Figure 20:
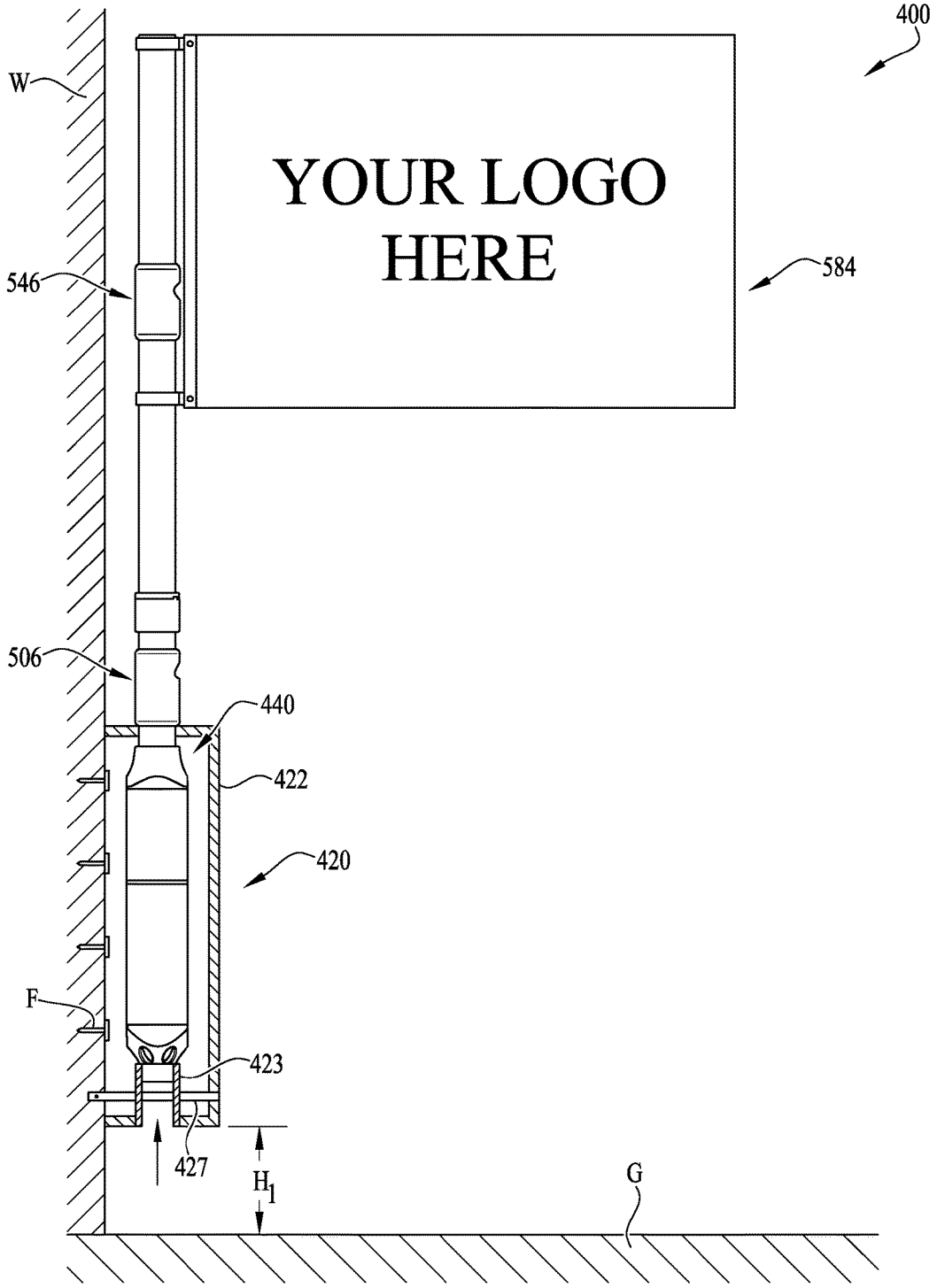
FIG. 20 shows a system for flying sheet materials according to another example embodiment of the present invention, showing the system mounted to a wall or rigid structure.
Figure 21:
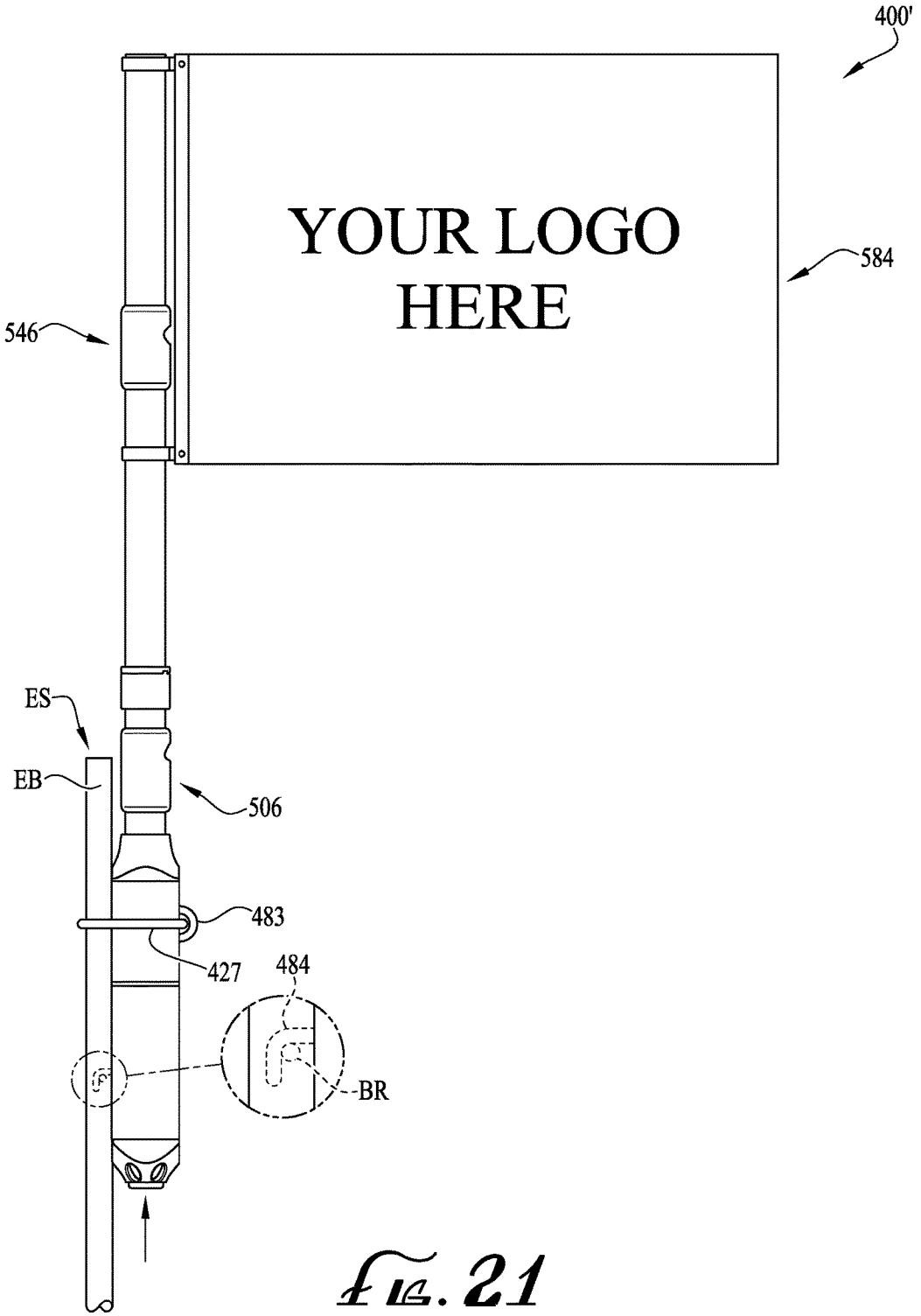
FIG. 21 shows a system for flying sheet materials according to another example embodiment of the present invention, showing the system removable connected to an exhibit structure or framing.
Figure 22:
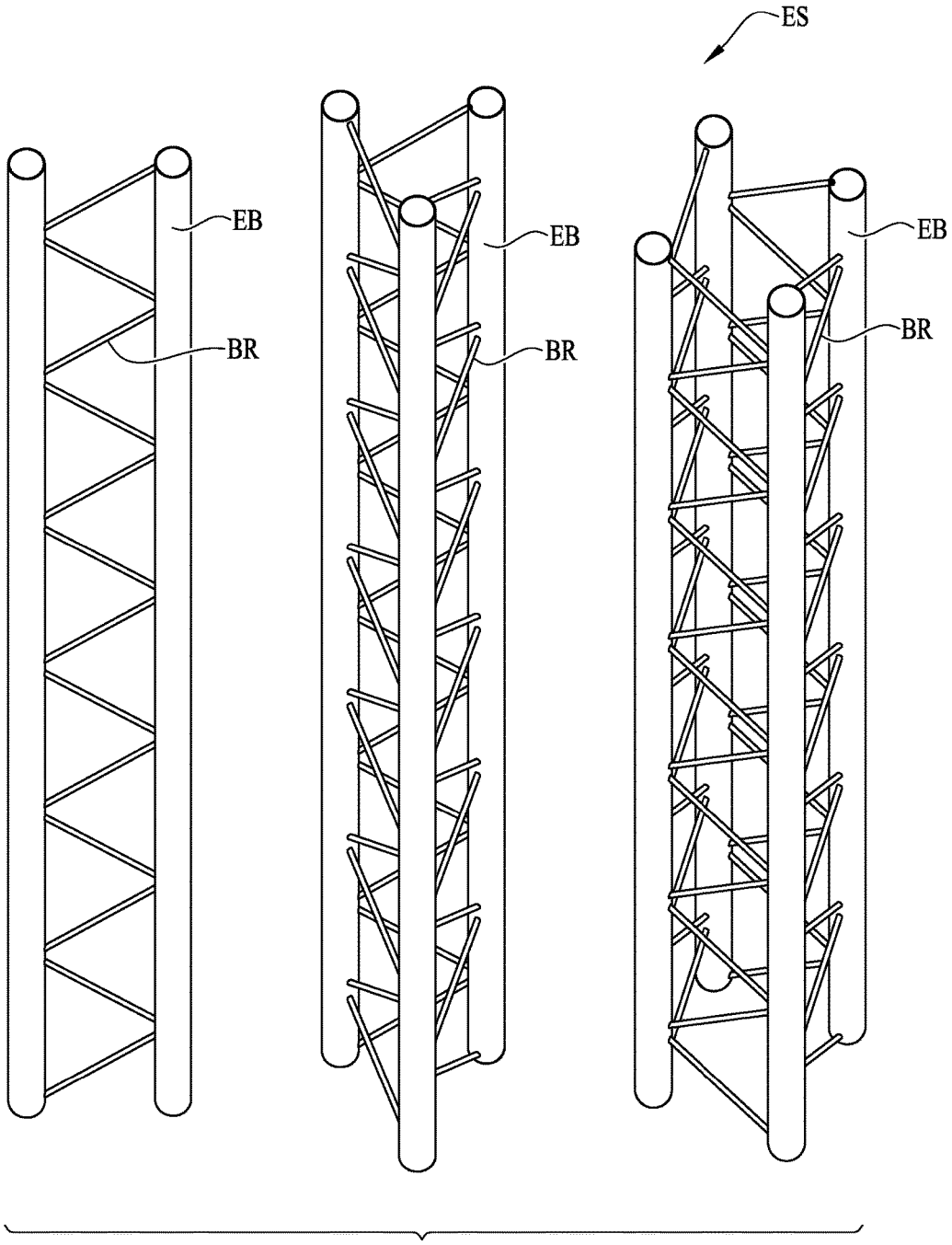
FIG. 22 shows example exhibit structures according to example embodiments of the present invention.

According to some example embodiments, the system for flying sheet materials can be permanently or temporarily mounted to an existing structure. For example, as depicted in FIG. 20, a system 400 is mounted to a wall W. In example embodiments, a housing 420 is mounted to the wall W with one or more fasteners F (and/or straps 427) at a height H1 above the ground surface G. In example embodiments, the height H1 can be chosen as desired, for example, wherein the height H1 is substantially zero or for example, wherein the height H1 is about 250 feet. Optionally, other heights H1 can be chosen as desired. According to another example embodiment, a system 400' can be mounted to a structure or framing ES, for example, wherein the structure ES can accept mounting of one or more systems 400', wherein a strap 427, clip 483 and/or other engagement members (e.g., engagement arm 484) provide for removably mounting the system 400' to the structure ES. FIG. 22 shows a plurality of commonly-used exhibit structures, for example, comprising one or more elongate members EB and one or more bracing members BR extending therebetween. Preferably, one or more connectors, straps, coupling members and/or other engagement members or fasteners can be provided for mounting the system 400' to the structure ES.

Figure 23:
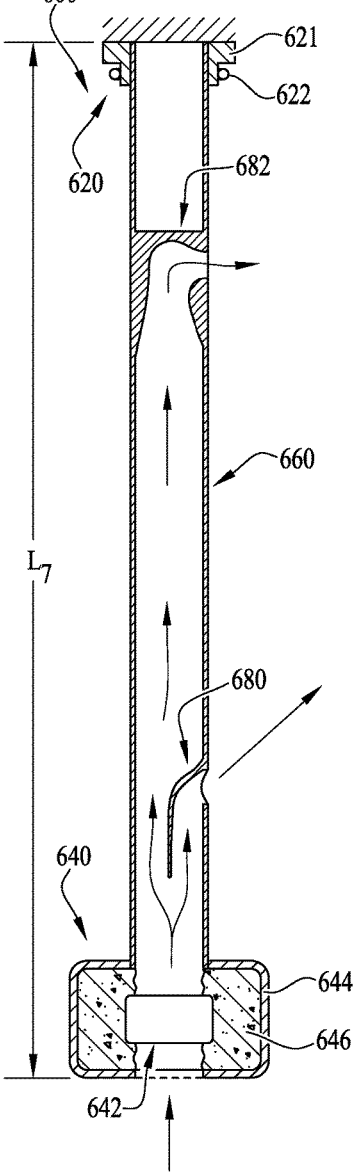
FIG. 23 shows a system for flying sheet materials according to another example embodiment of the present invention, wherein the system is generally suspended from a structure above a ground surface and provides airflow upwards in a single direction within the conduit and out at least one opening adjacent an airflow diverter to cause air to pass against the sheet material and unfurl the same.
Figure 24:
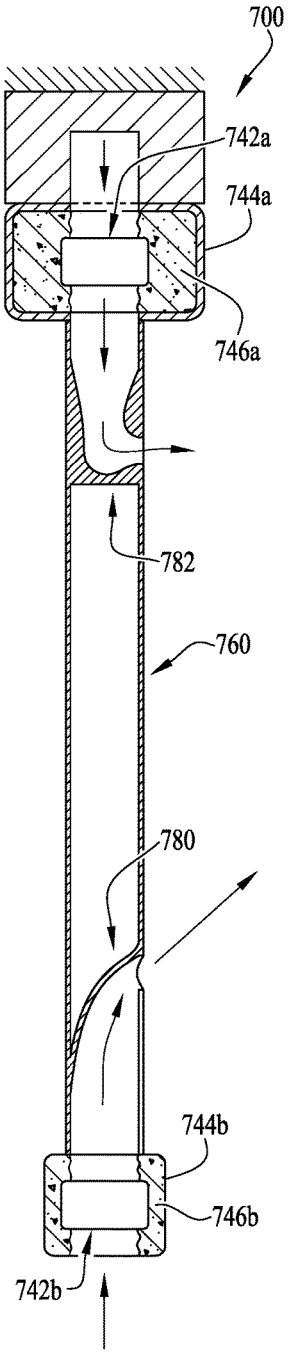
FIG. 24 shows a system for flying sheet materials according to another example embodiment of the present invention, wherein the system is generally suspended from a structure above a ground surface and provides airflow in two directions, upwards in a first direction within the conduit and downwards in a second and generally opposite direction within the conduit.
Figure 25:
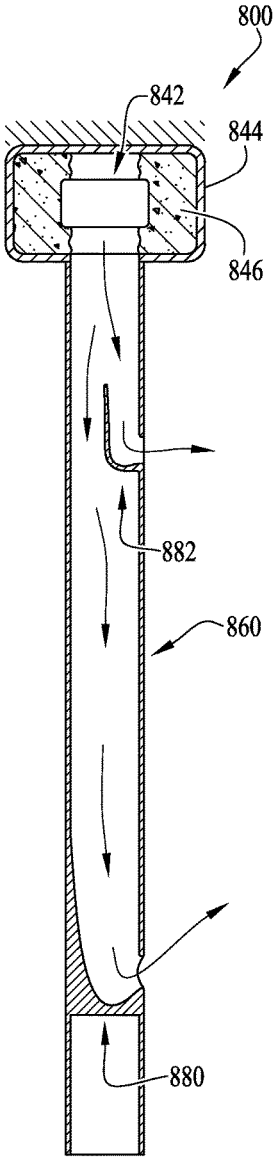
FIG. 25 shows a system for flying sheet materials according to another example embodiment of the present invention, wherein the system is generally suspended from a structure above a ground surface and provides airflow in a single downward direction within the conduit and out at least one opening adjacent an airflow diverter to cause air to pass against the sheet material and unfurl the same.

FIGS. 23-25 show a plurality of systems for flying sheet materials according to additional example embodiments of the present invention. As depicted, the systems 600, 700, 800 are preferably suspended from a ceiling or other structure above a ground surface, for example, wherein at least one fan outputs air in the conduit and out the one or more openings of the baffles to unfurl a sheet material that is attached thereto.

As depicted in FIG. 23, a base portion couples to the upper ceiling surface or structure, for example, wherein an upper collar 621 mounts to the upper surface and a pin 622 pivotally mounts a pole section 660 thereto. A blower assembly 640 is provided at a lower end of the pole 660, which comprises a fan 642 surrounded by a housing 644, and sound absorbing material 646 fitted within the housing. In example embodiments, the blower assembly 640 can be substantially to the blower assembly 40 as described above. In example embodiments, high velocity air generated by the fan 642 is forced upwards within the conduit and out openings of first and second baffle components 680, 682. According to one example embodiment, rather than a single fan forcing high velocity air upwards, more than one fan can be provided and wherein high velocity air can be forced both upwards and downwards within the conduit to unfurl the flag.

As depicted in FIG. 24, a first fan 742*a* is provided at an upper portion of the system 700 (generally near it's attachment to the upper structure) and a second fan 742*b* is provided at a lower portion of the system 700. In example embodiments, air is moved in both an upward direction and a downward direction to cause unfurling of the flag. For example, air flow being provided by fan 742*a* is moved from an upper portion of the pole 760 downwards and out an opening of the baffle component 782, and air flow being provided by fan 742*b* is moved from a lower portion of the pole 760 upwards and out an opening of the baffle component 780. According to yet another example embodiment, a fan 842 (and housing 844 and sound absorbing material 846) are position on an upper portion of the pole 860, and air flow is directed entirely downwards within the conduit and out openings of the baffle components 880, 882. According to one example embodiment, the air flow is configured to be directed downwards (at least momentarily), and out at least one baffle component in a direction comprising both a horizontal and vertical component.

Figure 26:
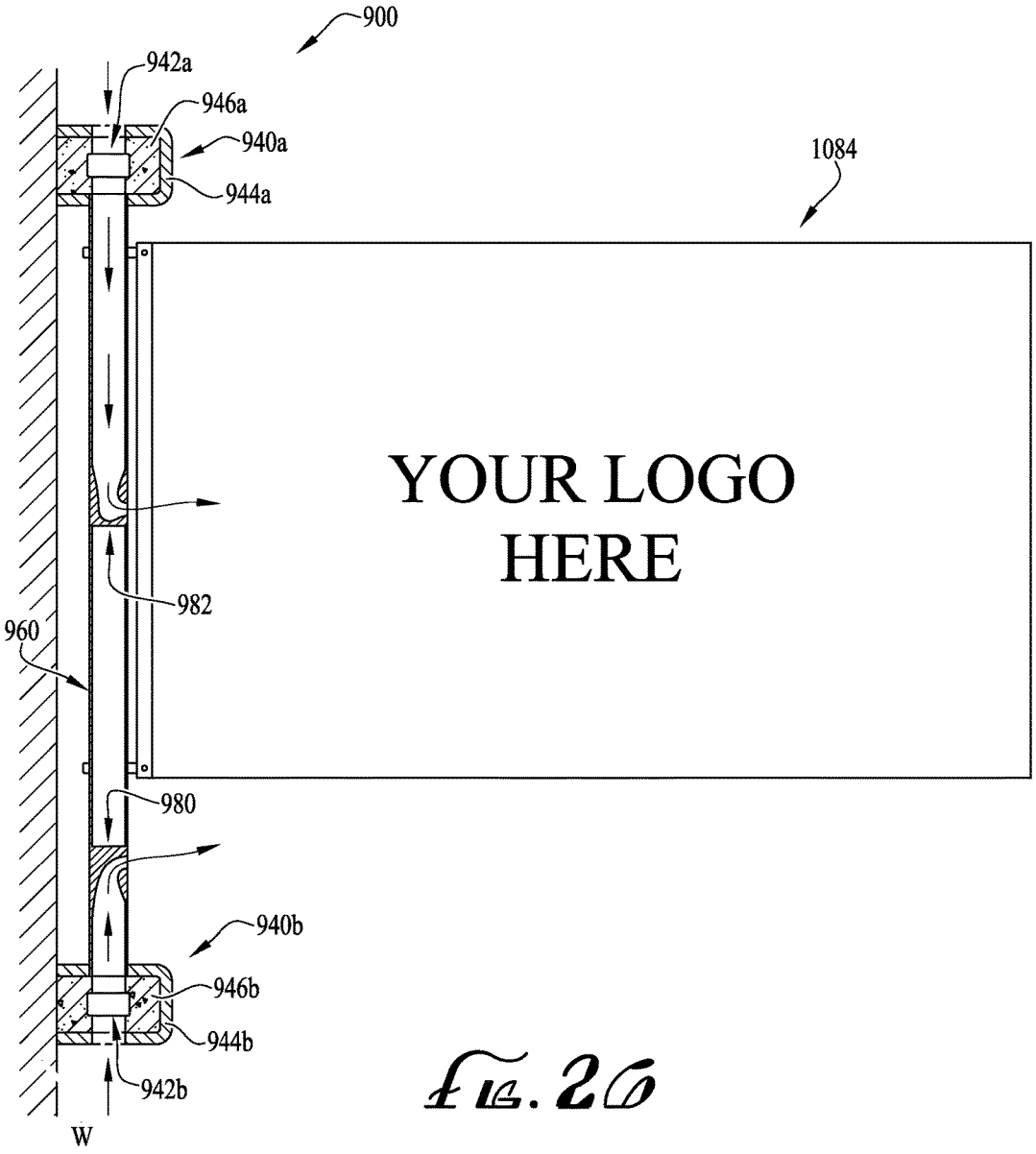
FIG. 26 shows a system for flying sheet materials according to another example embodiment of the present invention.

FIG. 26 shows a system 900 for flying sheet materials according to another example embodiment of the present invention. As depicted, the system 900 is generally mounted to a structure or wall W, for example, comprising a first blower assembly 940*a* positioned at an upper portion thereof and a second blower assembly 940*b* positioned at a lower portion thereof. In example embodiments, first and second baffle components 980, 982 are incorporated within the pole 960, wherein air being output from the second blower assembly 940*b* is redirected out of the pole 960 (via baffle component 980) and air being output from the first blower assembly 940*a* is redirected out of the pole (via baffle 982). According to example embodiments, the flag 1084 is sized to extend about 5 feet in length by about 3 feet in width. Optionally, the flag 1084 is sized to extend about 4 feet in length and about 2.5 feet in width. In other example embodiments, flags comprising other dimensions can be flown or unfurled on the system 900 as desired.

Figure 28:
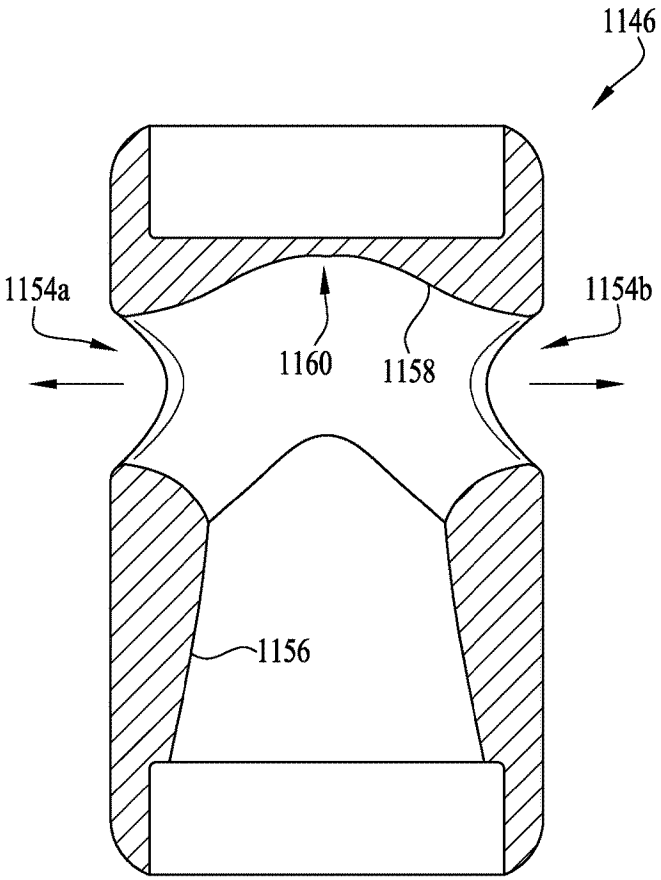
FIG. 28 shows a baffle component according to another example embodiment of the present invention, showing the baffle having two generally opposing outlet openings.
Figure 27:
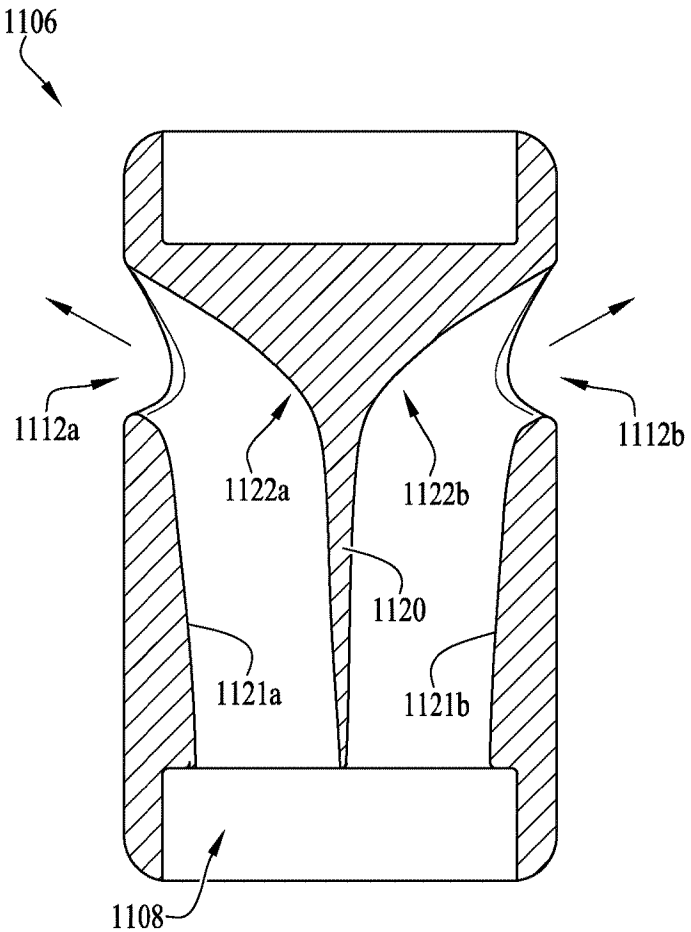
FIG. 27 shows a baffle component according to another example embodiment of the present invention, showing the baffle having two generally opposing outlet openings.

FIGS. 27-28 show example baffle components 1106, 1146 according to another example embodiment of the present invention. In example embodiments, the baffle components 1106, 1146 preferably comprise at least two outlet openings 1112*a*, 1112*b*, 1154*a*, 1154*b*, for example, such that at least two sheet materials or flags can be flown in opposite directions at the same time. For example, the baffle component 1106 comprises a divider member 1120 which divides the airflow passing therethrough into first and second paths, for example, wherein the first path is defined by the divider, an inner surface 1121*a*, a transition 1122*a*, and an outlet 1112*a*. Likewise, the second path is defined by the divider, an inner surface 1121*b*, a transition 1122*b*, and an outlet 1112*b*. In example embodiments, the baffle components

1106, 1146 can be preferably be used with the systems as disclosed herein. Preferably, a fan or air mover is provided for each baffle component 1106, 1146.

Figure 29:
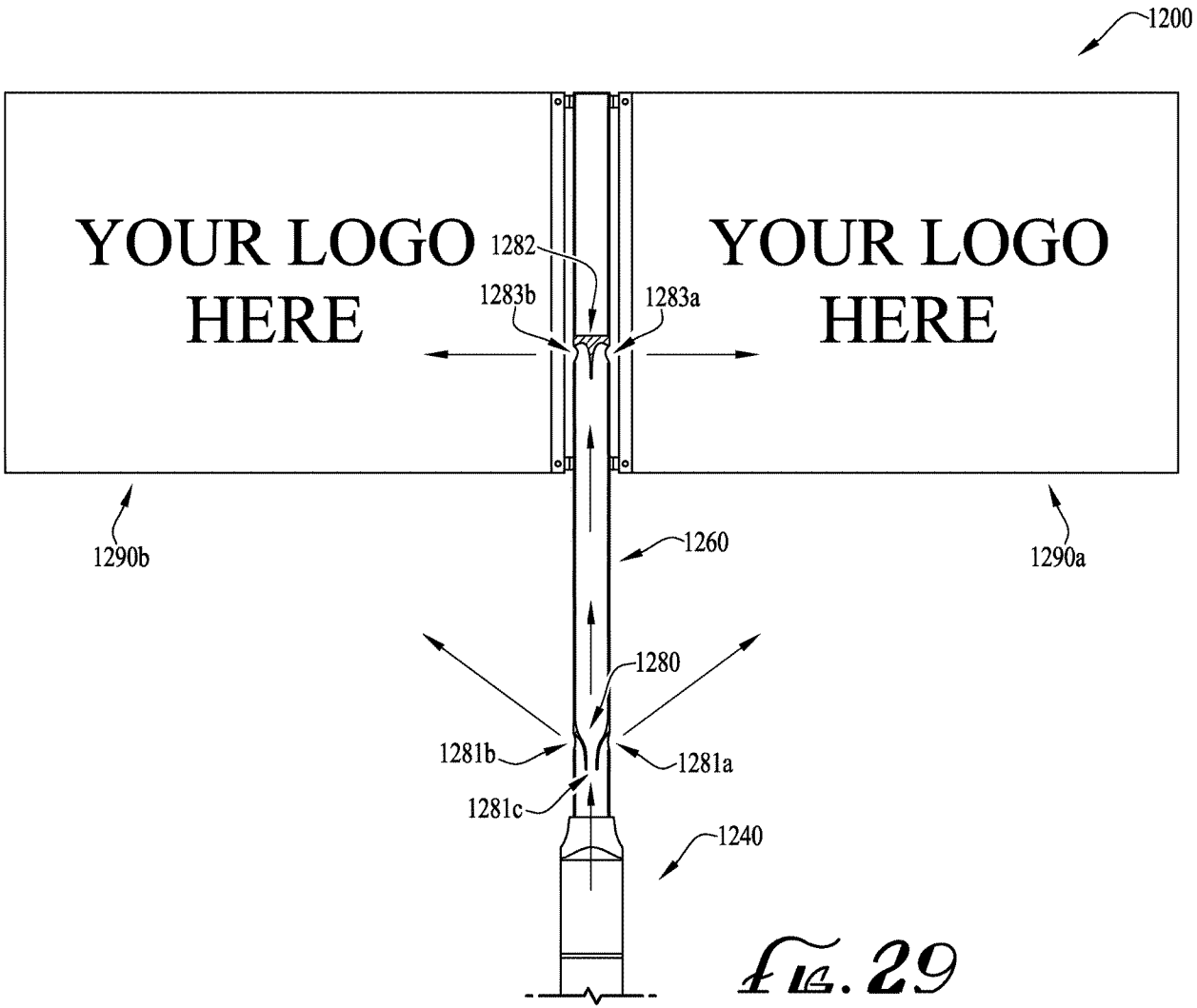
FIG. 29 shows a system for flying sheet materials according to another example embodiment of the present invention, showing the system flying at least two separate sheet materials in generally opposite directions.

FIG. 29 shows a system 1200 for flying sheet materials according to another example embodiment of the present invention. As depicted, the system 1200 is preferably unfurling two sheet materials or flags 1290*a*, 1290*b*, for example, wherein a blower assembly 1240 (comprising at least one fan) is positioned to force high velocity air upwards. Air passes through the pole 1260 to be directed by the baffle components 1280, 1282. In example embodiments, the baffle component 1280 comprises a first divider for directing air out of an opening 1281*a* in a first direction, a second divider for directing air out of an opening 1281*b* in a second direction, and a central channel 1281*c* for moving air up within the pole in a third direction to be directed by the baffle component 1282. In example embodiments, the air that passes through the central channel 1281*c* moves along the conduit and is directed out an opening 1283*a* in the first direction and out an opening 1283*b* in the second direction. In example embodiments, the fan size and output velocity can be adjusted accordingly to unfurl a desired-sized flag. In alternate example embodiments, one or more baffle components can be provided such that more than to flags can be unfurled and fly in different directions as desired. Or, for example, according to one example embodiment, the baffles can be configured such that two flags can fly in about the same direction but at different heights along the pole. In other example embodiments, two or more flags can be configured to fly from a single pole, regardless of their direction, position, orientation, etc. In other example embodiments, a pole can be provided per flag, for example, such that a plurality of poles can be grouped together and fly multiple flags in one or more direction.

Figure 30:
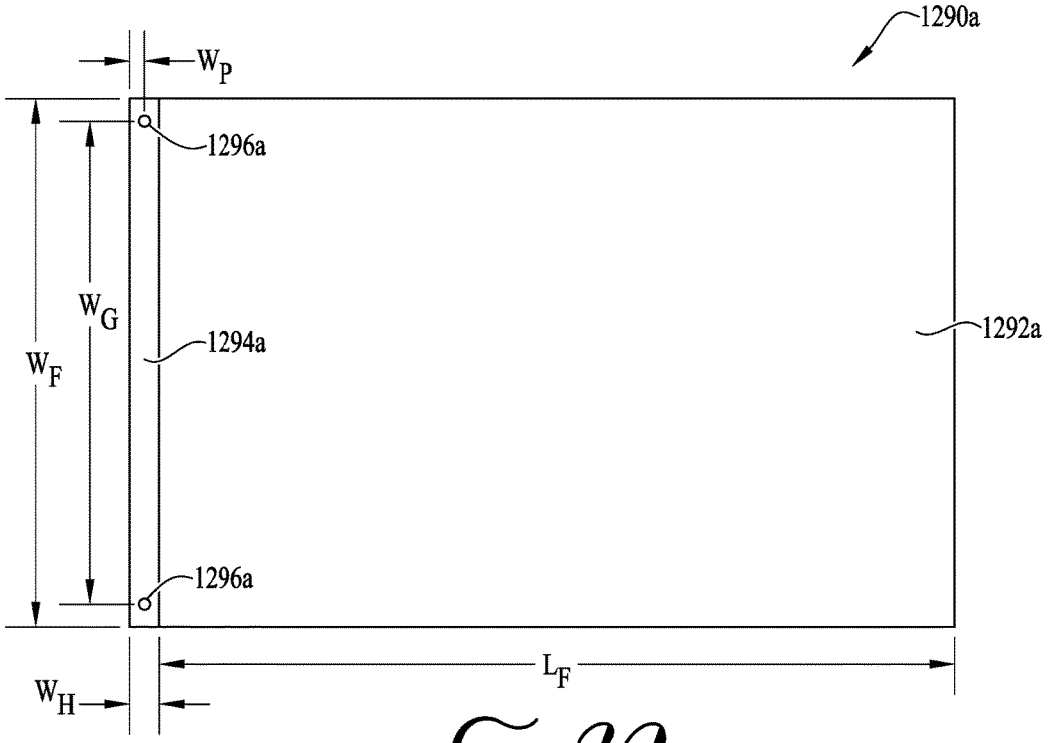
FIG. 30 shows a plan view of a sheet material in the form of a flag according to an example embodiment of the present invention.

FIGS. 30-33B show a plurality of flags for use with the system according to example embodiments of the present invention. FIG. 30 shows a flag 1290*a* according to example embodiments of the present invention. In example embodiments, the flag 1290*a* comprises a first section 1292*a*, which is generally printed on or comprises branding or indicia thereon, and a mounting or mast portion 1294*a*. In example embodiments, one or more grommets or connecting portions 1296*a* can be provided along a portion of the mounting portion 1294*a* for facilitating mounting or connecting the flag 1290*a* to a pole. In example embodiment, the flag 1290*a* comprises a length LF, a width WF, the mounting portion comprises a width WH, and the grommets 1296*a* are spaced apart to define a width WG therebetween.

Figure 31:
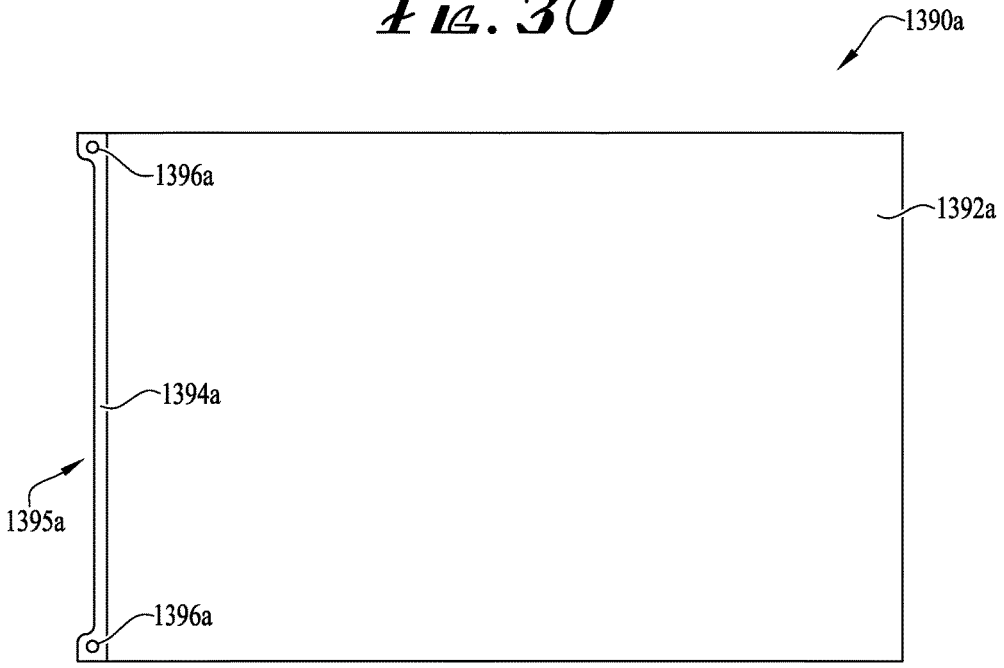
FIG. 31 shows a plan view of a sheet material in the form of a flag according to an example embodiment of the present invention, showing a cutout portion formed in a portion of the flag.
Figure 32:
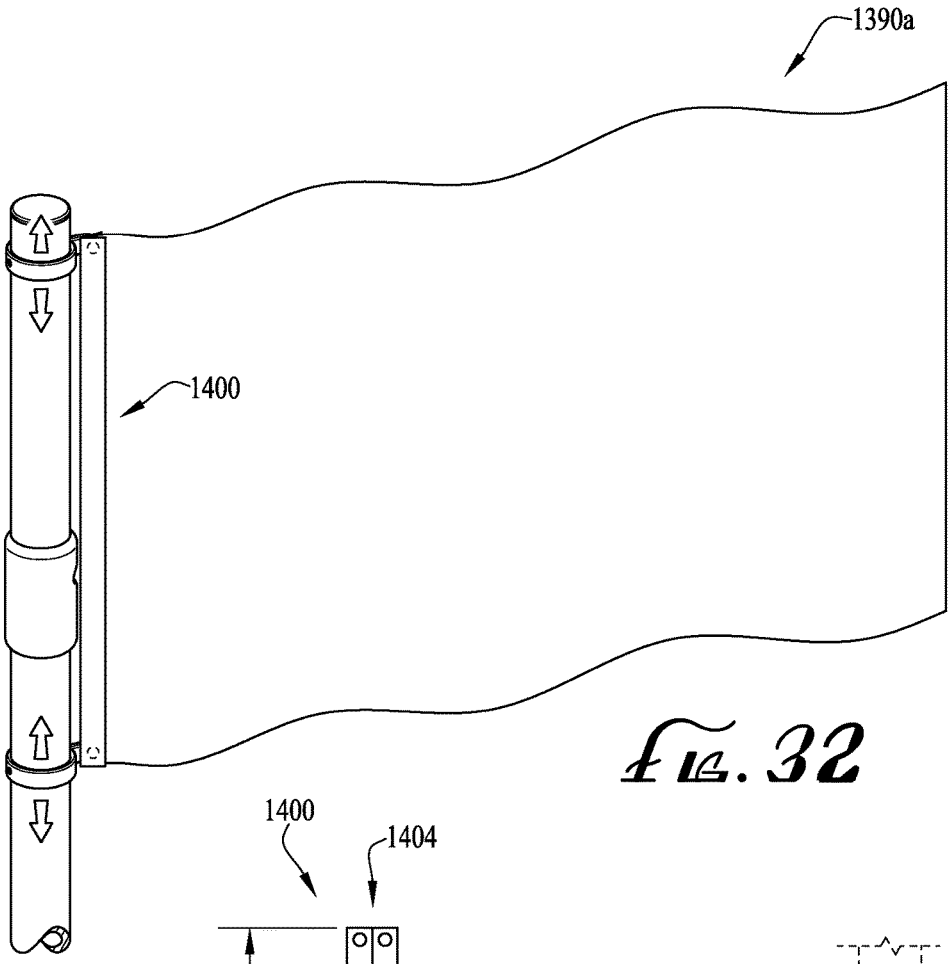
FIG. 32 shows a flag comprising an attachment component removably coupled to a portion thereof according to another example embodiment of the present invention, wherein the attachment component removably couples to couplings of the pole.

According to example embodiments, the length LF can be between about 4 inches-120 feet, the width WF can be between about 2 inches-60 feet, the width WH can be between about 0.25 inches-1 foot, and the width WG can preferably be configured to be positioned at a maximum width of the mounting portion, or for example, can be reduced to fit within the flag width as desired. According to one example embodiment, the length LF is about 3 feet, the width WF is about 2 feet, the width WH is about 1.5 inches, and the width WG is about 1.85 inches. In some example embodiments, the grommet's 1296*a* position is such that they are generally centered at a midpoint of the mounting portion 1294*a* (e.g., see WP). Optionally, the width WP of the grommets can be substantially zero wherein the grommets 1296*a* are positioned right beside a leading edge of the mounting portion 1294*a*. Optionally, as depicted in FIG. 31, the mounting portion 1394*a* can comprise a cutout portion 1395*a*, for example, to provide an improved edge for interaction with the airstreams exiting from the outlet openings of the baffles to unfurl the flag. For example, by the cutout portion, less material is provided on the mounting portion, and thus the airstreams are exposed to less material and/or surfaces which could cause inefficiencies in the airstreams. According to example embodiments, the flag 1290*a* comprises a polyester material. Any weight/weave can be chosen, for example, 100D, 150D, 200D, etc. Optionally, other materials can be used, for example, nylon, cottons, other polyester materials, synthetic materials, natural materials, and/or combinations thereof. In example embodiments, a printer or other image generating machine can be provided for printing or displaying desired indicia on the flag. Optionally, other formed of implementing indicia thereon can be provided, for example, stitching, sewing, adhering, heat treating, silk screening, and other various application methods. According to one example embodiment, a tightly woven material is beneficial in that little airflow is capable of passing through the sheet material, thereby forcefully causing movement of the sheet material, for example, to unfurl and fly the same as if an outdoor wind was present.

According to one example embodiment, a removable clamp or flag attachment member 1400 can be provided for engagement with the mounting portion of the flag 1390*a*. For example, in some example embodiments, rather than the flag coupling with one or more connectors or clips mounted to the pole, the flag attachment member 1400 is configured for attachment to the pole, for example, wherein the attachment member 1400 connects to the flag, and then the flag and connected attachment member 1400 provide for removable engagement with or more connectors, couplings, etc. of the pole. In example embodiments, the attachment member 1400 comprises an elongate member extending from a first end 1402 to a second end 1404 and defining a length LC and a width WC. In example embodiments, the length LC can generally be about the same width of the flag WF and the width WC is about twice the width of the mounting portion WH.

Figure 33A:
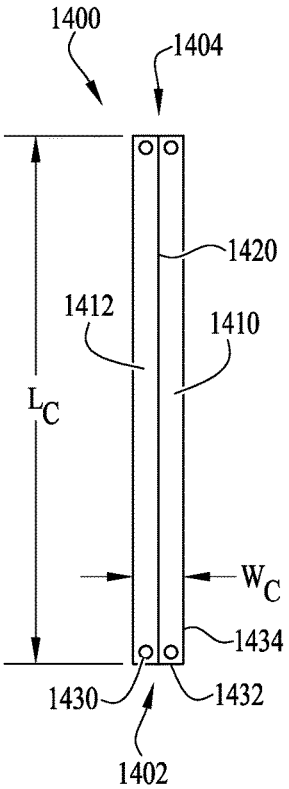
FIG. 33A shows a plan view of the attachment component of FIG. 32, the attachment component being in an unfolded configuration.
Figure 33B:
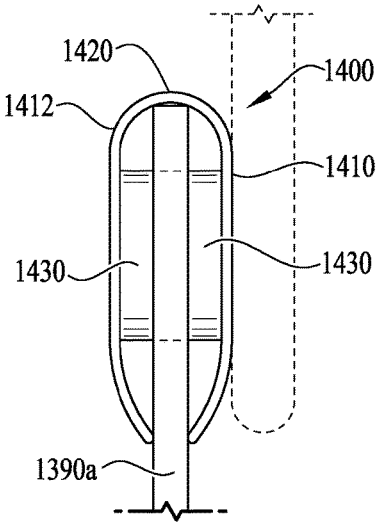
FIG. 33B shows a cross-sectional view of the attachment component in a folded configuration and removably attached together and generally sandwiching a portion of the flag therebetween as shown in FIG. 32.

In example embodiments, the attachment member 1400 comprises first and second pieces 1410, 1412 connected together by a living hinge 1420, which are foldable relative to each other between an open configuration (see FIG. 33A) and a closed configuration (see FIG. 33B). In example embodiments, one or more connectors, couplings, fasteners, magnets, ferromagnetic members, etc. 1430 can be provided within a portion of the attachment member 1400, for example, which are preferably engagable/connectable with connectors of the pole. According to one example embodiment, one or more magnetic or ferromagnetic members are embedded within the attachment member 1400 for facilitating clamping the mounting portion of the flag, and for removable attachment to the couplings of the pole. In some example embodiments, an edge 1434, 1432 or other surfaces of the attachment member 1400 can comprise one or more interengagement couplings or other clips, connectors, clasps, pins, interengaging connectors or other coupling members for maintaining a folded and clamped engagement with the mounting portion of the flag.

As depicted in FIG. 33B, the couplings of the pole (see dashed lines) comprise magnetic members for removable engagement with one or magnetic members 1430 of the attachment member 1400. According to some example embodiments, the attachment member 1400 can comprise an opening generally positioned near the attachment members 1430, and wherein an opposing coupling of the pole is spaced apart from the shown coupling such that the attachment member 1400 generally fits between the couplings of the pole, and wherein a pin or other engagement member extends through the entirety thereof to attach the flag to the pole. For example, according to some example embodiments, the couplings for attachment with the flag can be formed to provide spaced-apart arms defining a opening or channel therebetween for receiving a portion of the flag. Similarly, without the use of the attachment member 1400, a pin or engagement member can be provided for extending through the coupling arms (and through an opening of the grommet of the mounting portion of the flag).

In some example embodiments, the living hinge, when in the folded configuration, defines a rigid edge which efficiently allows for the one or more airstreams to pass and effectively unfurl the flag. For example, according to some example embodiments, the attachment member 1400 is generally shaped like an airfoil when folded and clamped on the mounting portion of the flag. Preferably, the couplings of the flag are movable along the length of the pole to accommodate attachment members of different lengths. Optionally, other couplings, connectors, magnets, etc. can be incorporated with the pole to provide for infinite adjustability thereof for accommodating removably mounting one or more attachment members (and flags clamped thereto) of a plurality of different sizes, and for example, for positioning the flag at a desired position along the length of the pole.

Figure 34:
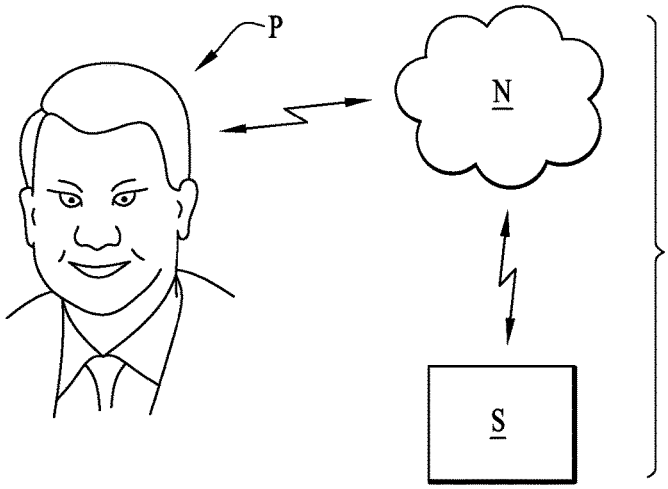
FIG. 34 shows a photo of a person for uploading to a server or online site according to another example embodiment of the present invention.
Figure 35:
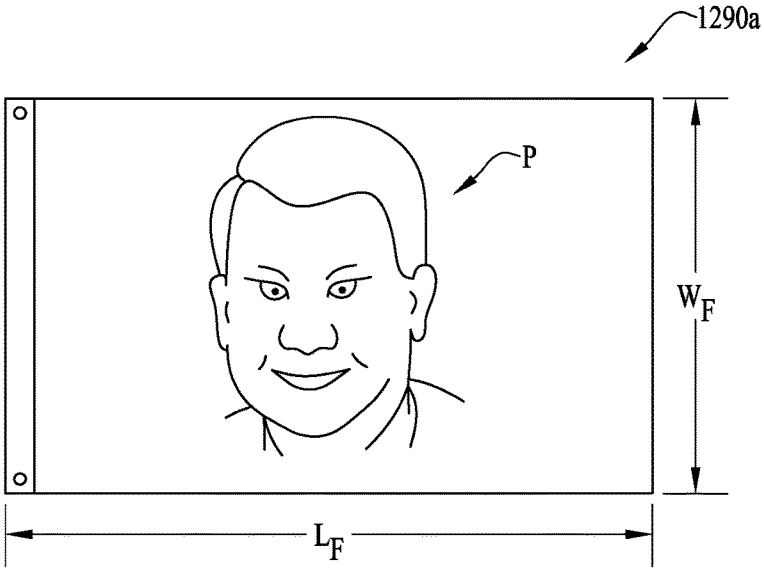
FIG. 35 shows a flag comprising the photo of FIG. 34 according to an example embodiment of the present invention.
Figure 36:
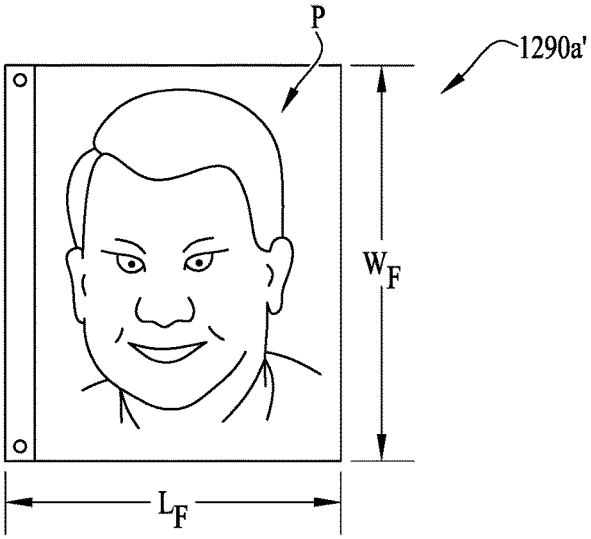
FIG. 36 shows a flag comprising the photo of FIG. 34 according to another example embodiment of the present invention.

FIGS. 34-36 show an example method of making a flag according to an example embodiment of the present invention. In example embodiments, preferably an image, logo, brad, or other indicia can be printed on the flag according a plurality of different methods. According to one example embodiment, a person's photo can be printed on a sheet material or flag, for example, wherein a photo P is uploaded to a website or online via a network N or cloud database on to a server or other database D. The photo P can then be edited and/or cropped as desired, and then printed on the flag 1290*a* (see FIG. 35). As depicted in FIG. 35, the flag 1290*a* comprises a length LF of about 3 feet and a width WF of about 2 feet. Optionally, as shown in FIG. 36, a flag 1290*a*' can be dimensioned differently, for example, comprising a length LF of about 1 foot and a width WF of about 1.5 feet.

Figure 37:
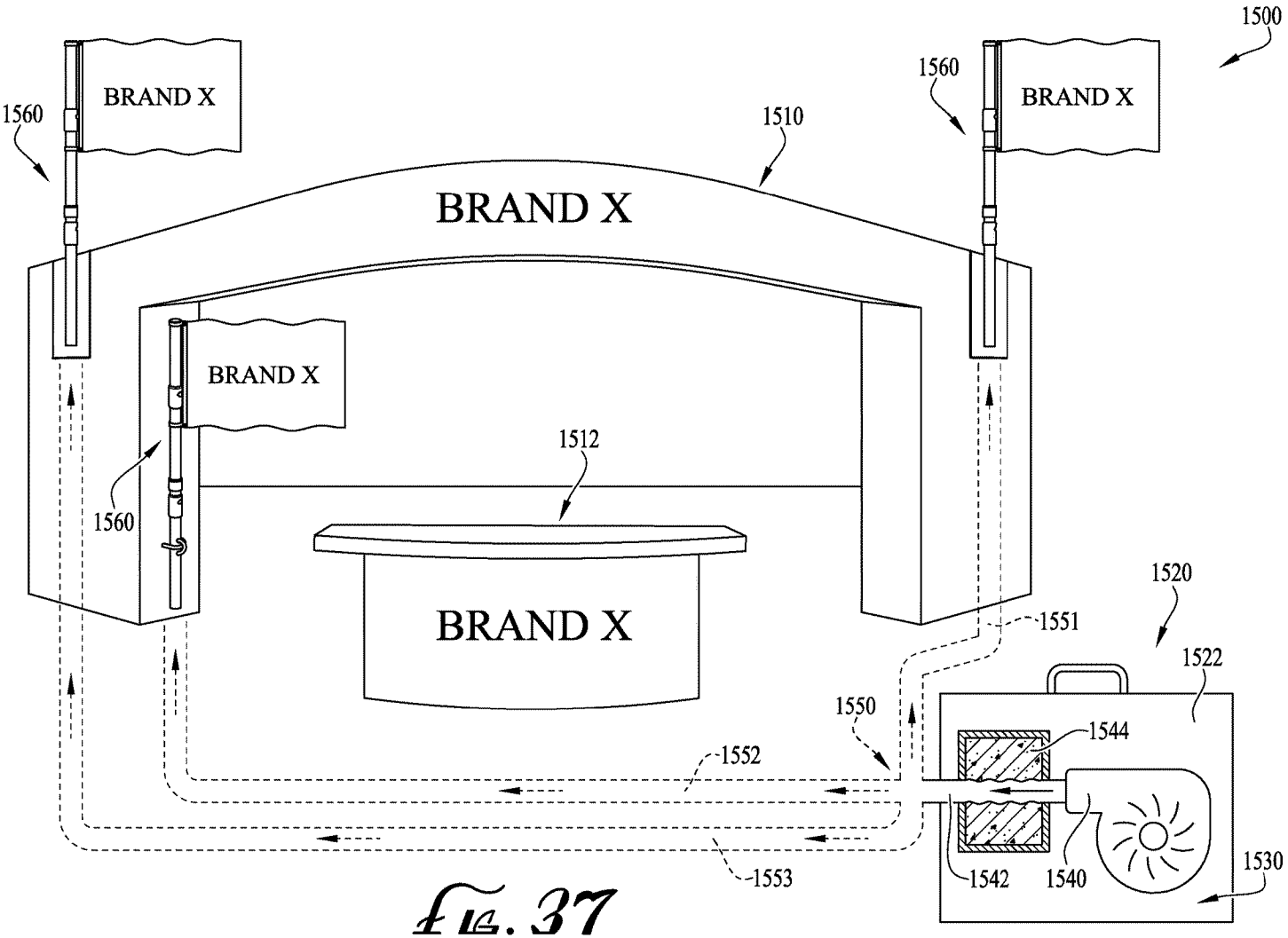
FIG. 37 shows an example exhibit or trade show structure or booth comprising a system for flying one or more sheet materials according to an example embodiment of the present invention.

FIG. 37 shows a system 500 for flying a plurality of sheet materials according to an example embodiment of the present invention. In example embodiments, one or more systems can preferably be provided at an exhibit or trade show booth 1510, for example, to assist a company or brand in exposing and/or drawing attention to their brand. As depicted, the system 1500 includes a base housing 1520 defining an internal space 1530 and comprising a blower 1540 and at least some sound absorption material 1544. A conduit 1542 is provided within the base housing 1520 and exits the same wherein a junction 1550 facilitates high velocity air exiting therefrom to move along in separate conduits to each individual system 1560. In example embodiments, a system 1560 is mounted to upper sides of the exhibit structure, and a third system 1560 is mounted to an end wall of the same structure at a lower position closer to the ground floor. In example embodiments, the system 1500 is preferably easy to assemble/disassemble and can be stored entirely within the base housing 1520 for transport. According to some example embodiments, the base housing 1520 is positioned in a discrete or hidden position behind the exhibit 1510 such that no equipment is exposed when using the systems to unfurl sheet materials.

According to one example embodiment, each of the systems 1560 and their respective conduits 1551, 1552, 1553 and be disassembled and stored within the base housing 1520 when not in use. Thus, according to example embodiments, the system 1500 is preferably travel and trade show friendly whereby limited effort and time is needed to set up or take down the system 1500. Optionally, according to other example embodiments, preferably other components of the systems as described herein can be incorporated with the system 1500. In some example embodiments, a plurality of flag flying systems can be used according to a system like system 1500. In some applications, for example, in entertainment, a plurality of systems can be provided which can traverse, rotate, etc. while unfurling the flag(s).

According to another example embodiment, a substantially large structure can be suspended from a ceiling or other structure above such that one or more flags can be provided on display in an unfurled configuration. For example, according to one example embodiment, at least about two pole assemblies can be positioned on a suspended structure and connected with fans or blowers, for example, and generally maintain their unfurled display while on the suspended structure. In some example embodiments, the structure and/or pole assemblies are movable (e.g., rotation, etc.) to provide additional movement and cause additional attention.

Figure 38:
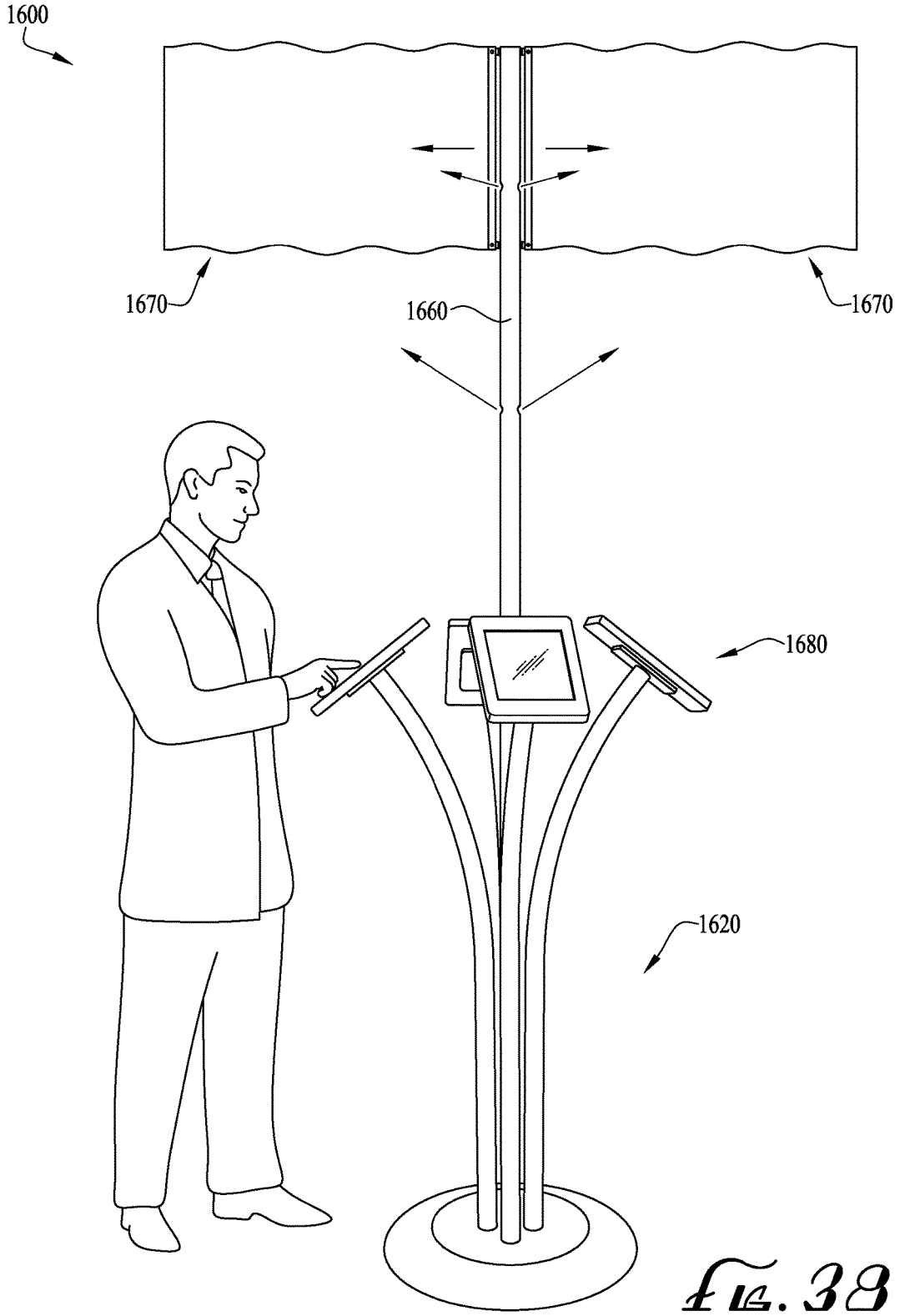
FIG. 38 shows a system for flying sheet materials according to another example embodiment of the present invention, showing the system flying at least two separate sheet materials in generally opposite directions from one or more poles, and showing a plurality of devices extending from a base of the system and displaying interactive electronic devices.

FIG. 38 shows a system 1600 for flying two sheet materials in opposite directions according to an example embodiment of the present invention. As depicted, the system 1600 comprises a base 1620, a blower assembly (unshown), a pole, a plurality of outlet openings for directing the airstreams outwards, a pair of flags 1670, and an engagement display 1680 generally near the pole 1660. In example embodiments, the system 1600 can preferably be provided at an exhibit or trade show booth, and wherein a user can become engaged with available information or other literature or interaction display of the engagement display 1680. According to one example embodiment, the engagement display 1680 comprises a plurality of electronic devices or tablets for engaging customers or users. Optionally, three or more flags can unfurl or fly from the pole as desired.

Figure 39:
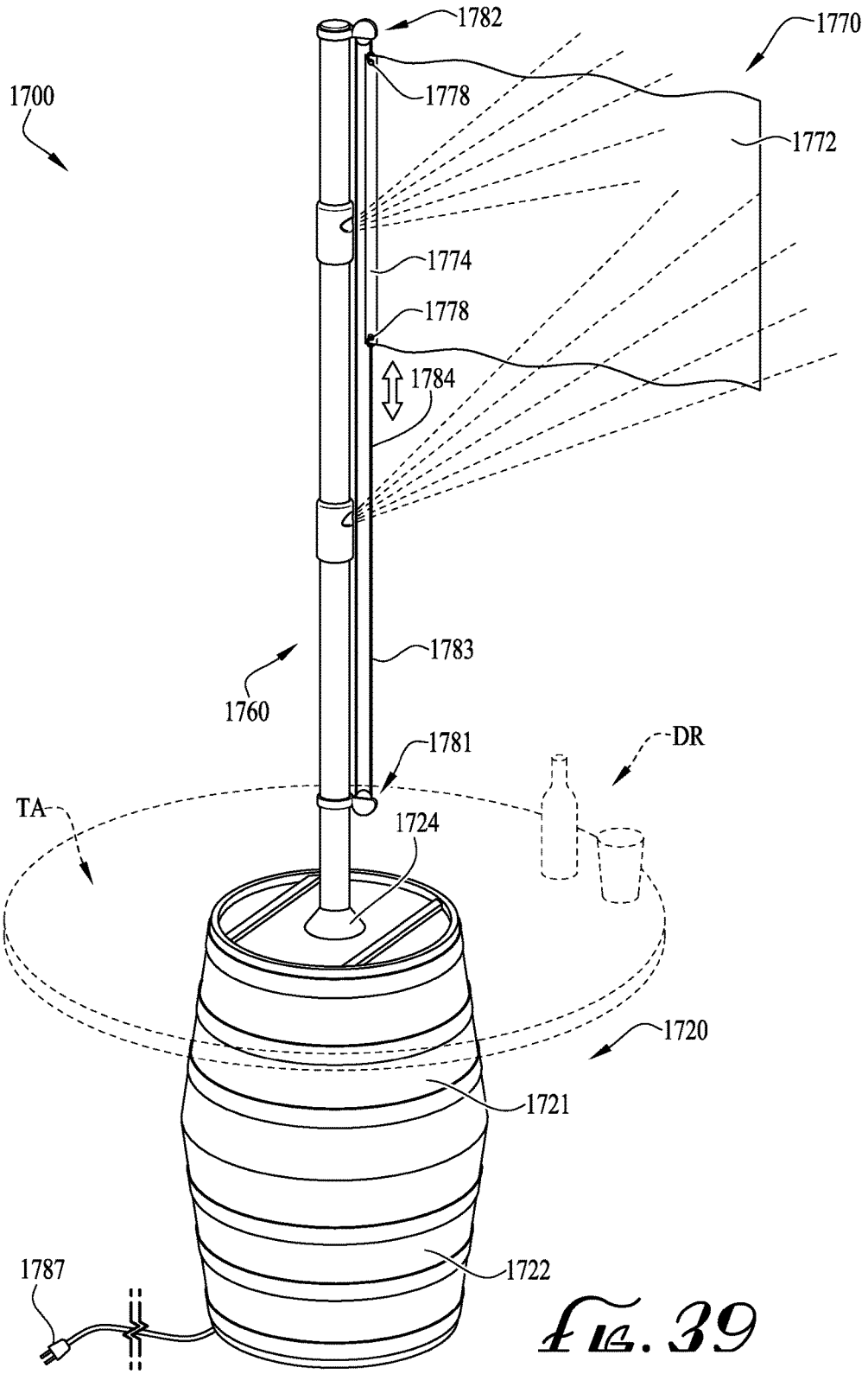
FIG. 39 shows a system for flying sheet materials according to another example embodiment of the present invention.
Figure 40:
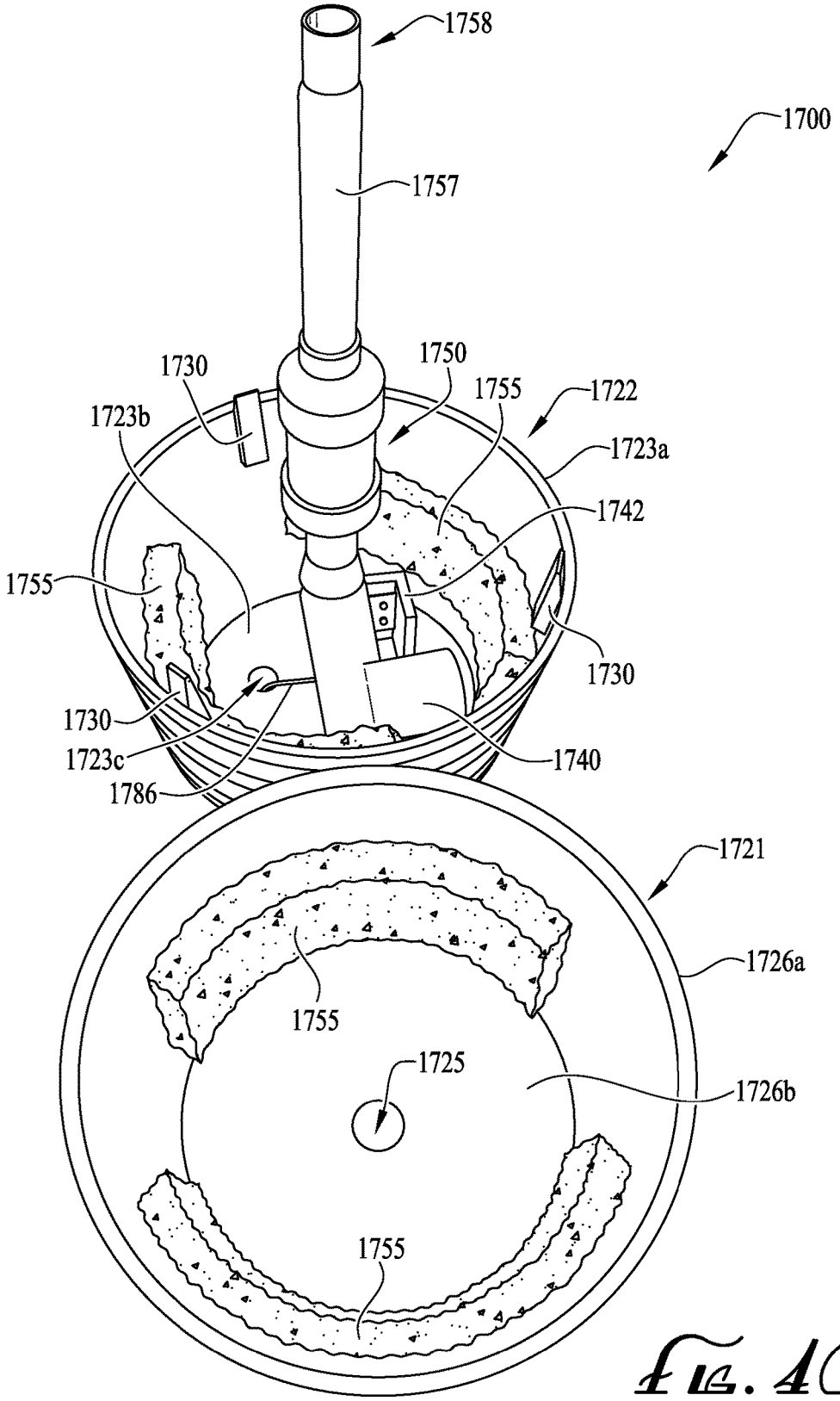
FIG. 40 shows the system of FIG. 39, wherein a portion of the base is disconnected therefrom to show internal portions thereof.
Figure 41:
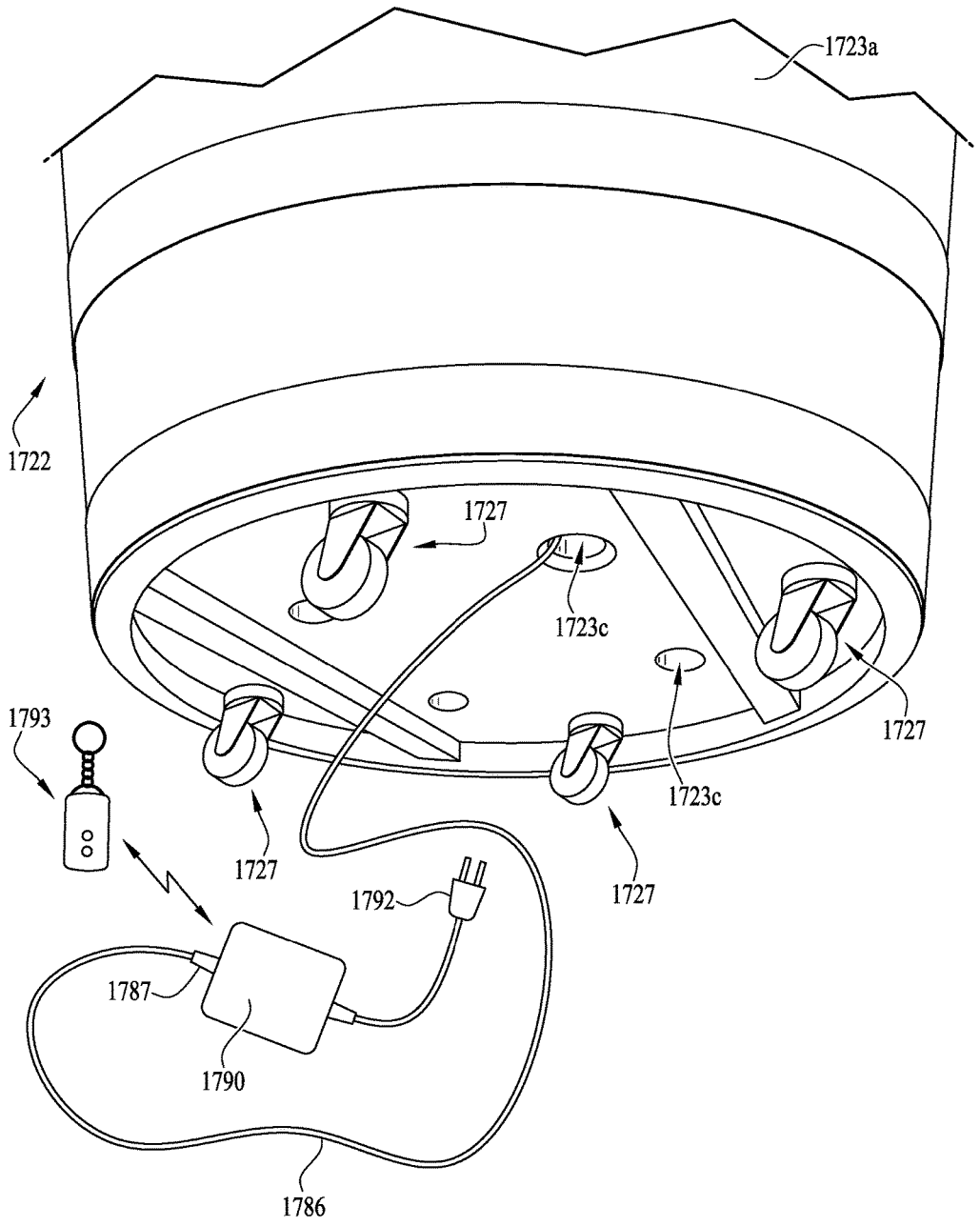
FIG. 41 shows a bottom perspective view of the base of the system of FIG. 39.

FIGS. 39-41 show a system 1700 for flying sheet materials according to another example embodiment of the present invention. In example embodiments, the system 1700 comprises a base 1720, a blower 1740 fitted within the base 1720, a pole assembly 1760 extending from the base in an upwards direction, and a flag 1770 unfurling itself and flying by forceful engagement with the airstreams exiting the outlet openings. In example embodiments, the system comprises a flag attachment mechanism comprising a pulley system including a first pulley 1781, a second pulley 1782, and a cord or rope member 1783 movable along the pulleys 1781, 1782 and comprising ends attached or coupled/connected to the grommets 1778 of the mounting portion 1774. In example embodiments, the cord 1783 comprises an elastic or stretchable portion therealong such that the mounting portion 1774 is properly tensioned. As depicted in FIG. 40, the base 1720 comprises an upper portion 1721 and a lower portion 1722. The lower portion comprises an outer wall 1723*a*, a floor 1723*b*, a plurality of nesting arms 1730 extending slightly above the outer wall 1723*a*, and one or more pieces of sound absorbing materials 1755 mounted within the lower portion 1723*a*. In example embodiments, the blower 1740 mounts to the floor 1723*b* by a mounting bracket 1742 (generally mounted in the center), and at least one inlet opening 1723*c* is provided for allowing passthrough of the electrical cable 1786 and electrical connector 1787. The upper portion 1721 comprises an outer wall 1726*a*, an upper ceiling portion 1726*b*, a central opening 1725 formed through the upper ceiling portion

1726*b*, and one or more pieces of sound absorbing material 1755. Optionally, one or more additional materials can be provided for facilitating sound absorption and/or dampening.

Figure 42:
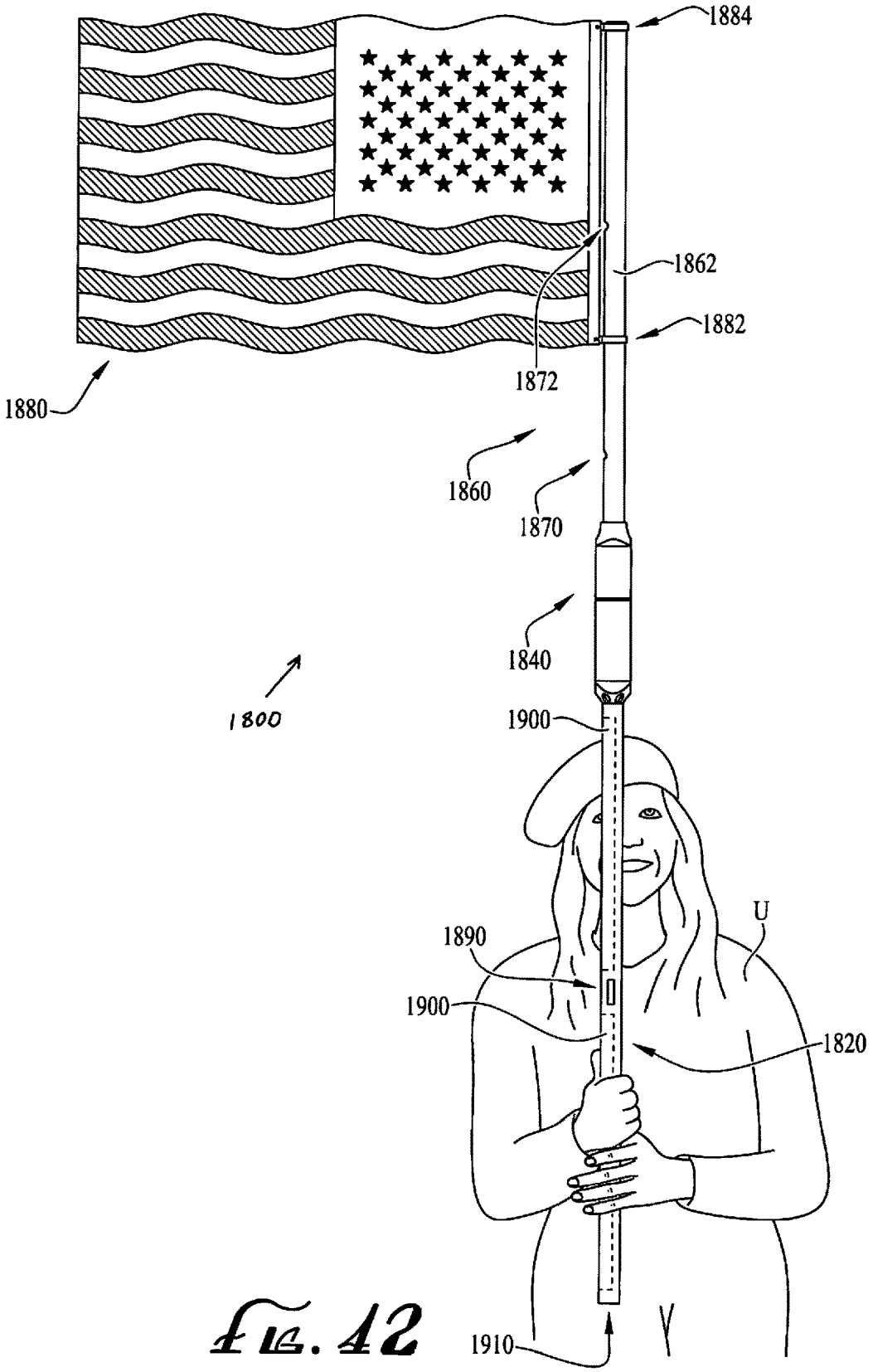
FIG. 42 shows a user holding a hand-held system for flying at least one sheet material according to another example embodiment of the present invention, wherein the system is battery-powered and light-weight for carrying and unfurling one or more sheet materials according to example embodiments of the present invention.

Attached to an outlet of the blower 1740 comprises a noise suppression device or muffler 1750, and extending therefrom is an intermediate pole portion 1757 comprising a reduced end 1758. In example embodiments, the reduced end 1758 of the intermediate pole portion 1757 is configured for engagement with the pole assembly, for example, to allow for disassembly, transport and storage. FIG. 42 shows a bottom portion of the lower portion 1722 of the base 1720. In example embodiments, one or more wheels 1727 can be provided such that the base 1720 can roll around on the ground surface. In some example embodiments, the system 1700 can be controlled by a remote control 1793, for example, to provide for wirelessly turning on and off the system 1700. According to one example embodiment, the electrical plug 1787 electrically connects with a control module 1790, and an electrical plug 1792 of the control module 1790 is electrically connected to a power outlet. Thus, a user can wirelessly transmit a signal (via remote control 1793) to either turn on or turn off the system 1700.

Referring back to FIG. 39, according to some example embodiments of the present invention, a tabletop or table-like surface TA can be provided with the system 1700. For example, a restaurant, bar or other eatery or event or engagement can comprise a flag flying system which incorporates an eating surface, or for example, a generally flat surface for holding or supporting other objects. In some example embodiments, the system 1700 can be used as a cocktail table for standing next to and assisting a user in supporting one or more beverages DR. Optionally, additional functionality can be integrated with the system 1700 as desired. According to one example embodiment, lobbies, even centers, or other placed can generally conceal a majority of the system such that generally only the pole assembly and flag are exposed. In some example embodiment, a large flower pot or topiary can act as a base for housing and concealing components of the system, for example, which could be used in a hotel, event center, arena, stadium, etc.

According to another example embodiment, the flag flying system can be portable for hand-held use. For example, FIG. 42 shows a user U carrying, holding or supporting a flag flying system 1800 according to an example embodiment of the present invention. According to one example embodiment, the user U is an Olympic athlete representing the United States of America at the opening and closing ceremonies. As depicted, the system 1800 comprises a base or handle/grasping portion 1820, a blower assembly 1840, a pole assembly 1860, and a sheet material or flag 1880 attached to the pole. In example embodiments, one or more outlet openings are provided such that at least one airstream is configured to exit the pole 1860 in a direction to unfurl the flag 1880. According to one example embodiment, the pole assembly 1860 comprises a first outlet opening 1870 and a second outlet opening 1872. Optionally, only one outlet opening can be provided, or for example, a plurality of outlet opening can be provided such that two or more flags can be unfurled from the same pole assembly 1860. In example embodiments, an activation interface or switch 1890 can be provided along a portion of the grasping portion 1820 to turn on or off the blower assembly 1840 such that the unfurling of the flag can be controlled. In example embodiments, one or more batteries 1900 or other energy storage components can be integrated within at least a portion of the system for powering the blower assembly, for example, rather than requiring the system be connected (by plug or wire) to an electrical outlet. An electrical connector or outlet 1910 can be provided along a portion of the system (depicted at a bottom end thereof) for recharging the batteries 1900. According to example embodiments, the batteries 1900 are capable of continuously powering the blower assembly (e.g., to fly flag 1880) for between about 1-8 hours on a single charge. Optionally, the batteries 1900 can be chosen as desired, for example, to provide a desired capacity. According to one example embodiment, a charging component/stand can be provided for charging the batteries 1900, which can also act as a base to stabilize and maintain the system 1800 in an upright position. Optionally, while the system is charging, the blower assembly 1840 can be powered to fly the flag while the system is stationary.

According to example embodiments, the system 1800 can be streamlined such that the blower assembly 1840 is generally concealed within a portion of the system such that the system visually looks like a standard flag pole. However, one or more outlet openings remain along at least a portion of the pole for outputting the airstream to fly the flag.

In example embodiments, the systems as described herein can further provide air filtration, adding a desired smell or scent to the environment or room, shooting out confetti, glitter, smoke, fireworks, or other entertaining effects. For example, according to some example embodiments of the present invention, one or more air filters can be implemented with the systems as described herein such that the air being output to fly one or more flags is purified, filtered air. According to one example embodiment, particles as small as 0.1 microns can be captured within the filter such that the air is pure to the fullest extent. According to one example embodiment, the air filter is HEPA approved.

According to additional example embodiments, the systems as described herein can be configured for outputting cool or hot air on demand. For example, an air conditioner can be incorporated with one or more systems for cooling or heating the environment where the system is being used.

In example embodiments, the device can connect to Wi-Fi, Bluetooth and/or other types of communication to control movement of the device, the flag position, whether the blower is running, releasing a scent, confetti, smoke, rotation of the pole, the addition of heating or cooling, activating a spotlight, etc. According to some example embodiments, the conduit or flag pole can be retractable, for example, wherein at least a portion can telescope (e.g., expand/contract). In some example embodiments, the pole and/or baffles can rotate based on a wind sensing systems, for example, such that in an outdoor setting the flag could automatically fly in the direction of the outdoor wind, if present. Otherwise, the flag flying system could be configured such that if no outdoor wind was present (e.g., outdoor wind must be about 6-10 mph or greater to trigger adjustment of pole and/or baffle direction), then the flag flying system would return to flying the flag in a preset direction. For example, in some example embodiments a motor or other mechanism can be coupled with a pole section or one or more of the baffle components to provide rotation thereto. According to some example embodiments, one or more servo motors or other mechanism can be implemented with the couplings of the pole (or implemented with the attachment clamp or other portions of the flag) such that the flag can be moved/turned independently of the coupling. Further optional, a plurality of systems can be combined to provide a synchronized system of flag flying systems. According to some example embodiments, the systems as disclosed herein can be miniaturized for table top use. Optionally, other systems and methods can be provided for directing air against at least a portion of a sheet material to cause unfurling of the same. According to another example embodiment, one or more lights, audible devices, cameras (still and video), and/or other components can be incorporated with the systems of the present invention.

According to another example embodiment, the systems as disclosed herein can preferably be adapted for retrofitting existing flag pole structures. For example, preferably, any existing flag pole can be retrofitted to include at least one fan and outlet along the pole such that high speed air generated by the fan can project from the outlet to cause the flag to unfurl and fly.

While the invention has been described with reference to example embodiments, it will be understood by those skilled in the art that a variety of modifications, additions and deletions are within the scope of the invention, as defined by the following claims.

What is claimed is:

1. A system for flying at least one sheet material comprising:

a conduit;

at least two airflow diverters defined within the conduit, wherein a first outlet is provided in the conduit and generally adjacent one of the at least two airflow diverters and wherein a second outlet is provided in the conduit and generally adjacent the other of the at least two airflow diverters; and a fan positioned relative to the conduit for moving high velocity air therethrough and out the at least two airflow diverters, wherein the at least one sheet material is connected to a portion of the conduit and nearby at least one of the at least two airflow diverters such that the high velocity air provides a force against the sheet material causing the same to unfurl.

2. The system of claim 1, further comprising a sound absorbing material in communication with the conduit.

3. The system of claim 2, wherein the sound absorbing material comprises melamine foam.

4. The system of claim 2, wherein the sound absorbing material is an open cell foam.

5. The system of claim 1, wherein the sheet material is a flag.

6. The system of claim 5, wherein the flag comprises polyester.

7. The system of claim 1, wherein the sheet material comprises indicia printed thereon.

8. The system of claim 1, wherein the sheet material is removably attached to a pair of repositionable coupling portions movably connected to the conduit.

9. The system of claim 1, wherein the system is collapsible and comprises a base for providing stability atop a ground surface.

10. The system of claim 1, wherein the system is mounted to a wall or suspended from a structure or ceiling that is spaced a distance from the ground surface.

11. The system of claim 1, wherein the system is powered by one or more batteries.

12. The system of claim 1, wherein at least one of the at least two airflow diverters of the conduit is generally positioned below the at least one sheet material that is connected to at least a portion of the conduit, and wherein high velocity air being projected from the opening of the at least one airflow diverter defines an airstream projecting positively in both the horizontal and vertical axes.

13. A system for flying sheet materials comprising:

a conduit extending along an elongate axis;

two or more baffle components defined within a portion of the conduit, wherein four or more outlets are provided in the conduit and generally adjacent the two or more baffle components; and one or more fans positioned relative to the conduit for moving high velocity air through the conduit along the elongate axis and the two or more baffle components and out the four or more outlets, wherein two or more sheet materials are connected to a portion of the conduit and nearby at least two of the four or more outlets such that the high velocity air is projected therefrom to provide a force against the two or more sheet materials and causing the same to unfurl.

14. The system of claim 13, wherein the two sheet materials are configured for being unfurled in opposite directions.

15. The system of claim 13, wherein the system is mounted to a wall or suspended from a structure or ceiling that is spaced a distance from the ground surface.

16. The system of claim 13, wherein a first fan is provided for moving air in a first direction and wherein a second fan is provided for moving air in a second direction.

17. The system of claim 16, wherein the first and second directions are substantially similar.

18. The system of claim 16, wherein the first and second directions are substantially different.

19. A system for flying sheet materials comprising:

a base housing defining an internal space;

a blower positioned within the internal space of the base housing;

two or more flag pole assemblies; and one or more conduit sections for connecting the two or more flag pole assemblies to the blower, wherein each of the two or more flap pole assemblies comprise at least two airflow diverters, wherein a first outlet is provided to be generally adjacent one of the at least two airflow diverters and wherein a second outlet is provided to be generally adjacent the other of the at least two airflow diverters.

20. The system of claim 19, wherein the two or more flag pole assemblies are mounted to a structure, and wherein the one or more conduit sections provide communication between the flag pole assemblies and the blower such that high velocity air generated from the blower is output through the one or more conduit sections and out one or more of the outlets of the at least two airflow diverters of each of the two or more flag pole assemblies to unfurl one or more sheet materials connected to the two or more flag pole assemblies.

21. The system of claim 19, further comprising at least one sound absorption material provided within the base housing.

* * * * *